US009310762B2

(12) United States Patent
Kanno et al.

(10) Patent No.: US 9,310,762 B2
(45) Date of Patent: Apr. 12, 2016

(54) PROCESS CARTRIDGE AND ELECTROPHOTOGRAPHIC IMAGE FORMING APPARATUS

(71) Applicant: CANON KABUSHIKI KAISHA, Tokyo (JP)

(72) Inventors: Kazuhiko Kanno, Odawara (JP); Yasufumi Yoshino, Numazu (JP); Katsuhiko Oba, Odawara (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/321,113

(22) Filed: Jul. 1, 2014

(65) Prior Publication Data

US 2014/0314445 A1 Oct. 23, 2014

Related U.S. Application Data

(62) Division of application No. 13/920,163, filed on Jun. 18, 2013, now Pat. No. 8,805,237, which is a division of application No. 13/414,036, filed on Mar. 7, 2012, now Pat. No. 8,494,410, which is a division of (Continued)

(30) Foreign Application Priority Data

Dec. 8, 2006 (JP) ..... 2006-331309
Oct. 12, 2007 (JP) ..... 2007-266399

(51) Int. Cl.
*G03G 21/18* (2006.01)

(52) U.S. Cl.
CPC ..... *G03G 21/1842* (2013.01); *G03G 21/18* (2013.01); *G03G 21/185* (2013.01); *G03G 2221/1654* (2013.01); *G03G 2221/1861* (2013.01); *G03G 2221/1884* (2013.01)

(58) Field of Classification Search
CPC . G03G 21/18; G03G 21/1842; G03G 21/185; G03G 2221/1654; G03G 2221/1861; G03G 2221/1884
See application file for complete search history.

(56) References Cited

U.S. PATENT DOCUMENTS 4,708,455 A 11/1987 Kubota et al.
5,014,094 A 5/1991 Amitani et al.

(Continued)

FOREIGN PATENT DOCUMENTS

CN 1664721 9/2005
JP 629998 B2 4/1994

(Continued)

OTHER PUBLICATIONS

Notice of Allowance in Korean Patent Application No. 10-2009-7012431, issued May 30, 2011.

(Continued)

*Primary Examiner* — Gregory H Curran
(74) *Attorney, Agent, or Firm* — Fitzpatrick, Cella, Harper & Scinto

(57) ABSTRACT

A process cartridge is detachably mountable to a main assembly of an electrophotographic image forming apparatus. The cartridge includes a drum, first and second guidable portions guidable by first and second guides when the cartridge enters or advances in the main assembly, first and second regulatable portions provided at leading and trailing sides of the cartridge with respect to the advancing direction and regulated by a first main assembly regulator when the process is advancing in the main assembly, and first and second positionable portions to be positioned at first and main assembly second positioners, respectively, by the urging force of a main assembly urging member after the first and second regulatable portions pass the first and second regulators, respectively. The cartridge is mounted to the main assembly with the first and second positionable portions at the first and second positioners, respectively, by the urging force of the urging member.

5 Claims, 15 Drawing Sheets

Related U.S. Application Data application No. 12/716,641, filed on Mar. 3, 2010, now Pat. No. 8,155,557, which is a division of application No. 11/925,286, filed on Oct. 26, 2007, now Pat. No. 7,756,441.

(56) References Cited

U.S. PATENT DOCUMENTS

| | | | |
|---|---|---|---|
| 5,640,229 | A | 6/1997 | Nakahara |
| 5,848,329 | A | 12/1998 | Aoyama et al. |
| 5,995,782 | A | 11/1999 | Isobe et al. |
| 6,301,456 | B1 | 10/2001 | Horrall et al. |
| 6,980,758 | B2 | 12/2005 | Murayama et al. |
| 7,116,925 | B2 | 10/2006 | Yamaguchi et al. |
| 7,184,687 | B2 | 2/2007 | Yamaguchi et al. |
| 7,519,310 | B2 | 4/2009 | Yamaguchi et al. |
| 8,155,557 | B2 | 4/2012 | Kanno et al. |
| 2005/0220481 | A1 | 10/2005 | Yamaguchi et al. |
| 2005/0220484 | A1 | 10/2005 | Konishi |
| 2006/0045566 | A1 | 3/2006 | Kanno et al. |
| 2009/0180799 | A1 | 7/2009 | Yamaguchi et al. |

FOREIGN PATENT DOCUMENTS

| | | | |
|---|---|---|---|
| JP | 6186791 | | 7/1994 |
| JP | 10-78737 | | 3/1998 |
| JP | 2001-312197 | | 11/2001 |
| JP | 2005-266781 | A | 9/2005 |
| RU | 2004 126 181 | A1 | 12/2006 |

OTHER PUBLICATIONS

Decision on Grant in Russian Patent Application No. 2009126152/28(036393), with English translation.

Chinese Office Action dated Jun. 22, 2010, in Chinese Application No. 200780023905.9, and English-language translation thereof.

International Search Report and Written Opinion of the International Searching Authority dated Feb. 26, 2008, in International Application No. PCT/JP2007/073268.

Office Action in Chinese Patent Application No. 201110318886.0, mailed Jan. 14, 2013 (with English translation).

Decision on Grant in Russian Patent Application No. 201103939/28 (005441), mailed Jan. 30, 2014 (with English translation).

PROCESS CARTRIDGE AND ELECTROPHOTOGRAPHIC IMAGE FORMING APPARATUS

FIELD OF THE INVENTION AND RELATED ART

The present invention relates to a process cartridge, and an image forming apparatus which employs a process cartridge.

Here, an "electrophotographic image forming apparatus" means an apparatus, such as an electrophotographic copying machine, an electrophotographic printer (laser beam printer, LED printer, etc.), or the like, which forms an image on recording medium, with the use of an electrophotographic image forming method.

A "process cartridge" means a cartridge in which an electrophotographic photosensitive drum, and one or more process means, that is, a charging means, and a developing means or a cleaning means, for processing the electrophotographic photosensitive drum, are integrally disposed so that they can be removably mountable in the main assembly of the image forming apparatus. More specifically, a process cartridge is a cartridge in which an electrophotographic photosensitive drum, and at least one among the abovementioned processing means, such as a developing means, a charging means, and a cleaning means, are integrally disposed. It also means a cartridge in which at least a developing means as a processing means, and an electrophotographic photosensitive drum, are integrally disposed so that they can be removably mountable in the main assembly of an electrophotographic image forming apparatus.

In the field of an electrophotographic image forming apparatus which employs one of the electrophotographic image formation processes, a process cartridge system has long been employed, according to which an electrophotographic photosensitive drum, and a single or plurality of processing means which act on the electrophotographic photosensitive drum, are integrally disposed in a cartridge to make it possible for them to be removably mountable in the main assembly of the image forming apparatus. Also according to this process cartridge system, an image forming apparatus can be maintained by a user himself, without relying on a service person, drastically improving the image forming apparatus in operability. Thus, a process cartridge system is widely in use in the field of image forming apparatus.

The image forming operation of an electrophotographic image forming apparatus is as follows: First, the electrophotographic photosensitive drum is exposed to a beam of light projected from a laser, an LED, an ordinary electric light, or the like, while being modulated with pictorial information, forming thereby an electrostatic latent image on the photosensitive drum. The electrostatic latent image is developed by the developing apparatus. Then, the developed image on the photosensitive drum is transferred onto recording medium; an image is formed on the recording medium.

As regards the structure for positioning the process cartridge in the main assembly of the image forming apparatus, the following structure is known. A supporting member for supporting the process cartridge is pushed into the main assembly of the apparatus. Then, the process cartridge is raised by the engagement between the cartridge side positioning portion and the main assembly side positioning portion. Thereafter, the process cartridge is separated from the supporting member. In this manner, the process cartridge is positioned to the main assembly without interference from the supporting member. (Japanese Laid-open Patent Application Hei 6-29998). It is desirable that the mounting and the mounting operation of the process cartridge relative to the main assembly of the apparatus is simple and easy.

The present invention is one of the further developments of the above described prior art.

SUMMARY OF THE INVENTION

Thus, the primary object of the present invention is to provide a process cartridge and an electrophotographic image forming apparatus in which when the process cartridge is mounted to the main assembly of the apparatus, a first cartridge side portion to be positioned and a second cartridge side portion to be positioned are less frictioned relative to a member or members of the main assembly.

It is another object of the present invention to provide a process cartridge and an electrophotographic image forming apparatus in which when the process cartridge is mounted to the main assembly of the apparatus, a first cartridge side portion to be positioned and a second cartridge side portion to be positioned are less contacted to a member or members of the main assembly.

It is a further object of the present invention to provide a process cartridge and an electrophotographic image forming apparatus in which the mounting operativity of the process cartridge relative to the main assembly of the apparatus is improved.

It is a further object of the present invention to provide a process cartridge and an electrophotographic image forming apparatus in which the process cartridge can be mounted to the main assembly of the apparatus with the stability.

It is a further object of the present invention to provide a process cartridge and an electrophotographic image forming apparatus in which the positioning accuracy of the process cartridge in the main assembly is improved.

It is a further object of the present invention to provide a process cartridge and an electrophotographic image forming apparatus in which the positioning accuracy of the process cartridge in the main assembly is stably high.

According to an aspect of the present invention, there is provided a process cartridge detachably mountable to a main assembly of an electrophotographic image forming apparatus, wherein said apparatus includes a first main assembly side positioning portion, a second main assembly side positioning portion, a first main assembly side guide, a second main assembly side guide, a first main assembly side regulating portion, a second main assembly side regulating portion, an urging member for urging process cartridge to the main assembly side positioning portion by an urging force, said process cartridge comprising an electrophotographic photosensitive drum; process means actable on said electrophotographic photosensitive drum; a first cartridge side portion-to-be-guided to be guided by the first main assembly side guide when said process cartridge enters the main assembly along an axial direction of said electrophotographic photosensitive drum; a second cartridge side portion-to-be-guided to be guided by the second main assembly side guide when said process cartridge advances in the main assembly along the axial direction of the electrophotographic photosensitive drum in mounting it to the main assembly; a first cartridge side portion-to-be-regulated, provided at a leading side with respect to the advancing direction, for being regulated by the first main assembly side regulating portion in upward movement thereof when said process cartridge advancing in the main assembly while being guided by the first main assembly side guide and the second main assembly side guide is urged upwardly by the urging force of said urging member; a second cartridge side portion-to-be-regulated, provided at a trailing side with respect to the advancing direction, for being regulated by the first main assembly side regulating portion in upward movement thereof when said process cartridge advancing in the main assembly while being guided by the first main assembly side guide and the second main assembly side guide is urged upwardly by the urging force of said urging member; a first cartridge side portion to be positioned to be positioned at the first main assembly side positioning portion by the urging force of said urging member after said first cartridge side portion-to-be-regulated advancing in the main assembly while being regulated in the upward movement by said first main assembly side regulating portion passes the first main assembly side regulating portion; and a second cartridge side portion to be positioned to be positioned at the second main assembly side positioning portion by the urging force of said urging member after said second cartridge side portion-to-be-regulated advancing in the main assembly while being regulated in the upward movement by said second main assembly side regulating portion passes the second main assembly side regulating portion, wherein said process cartridge is mounted to the main assembly with said first cartridge side portion to be positioned at the first main assembly side positioning portion by the urging force of said urging member and with said second cartridge side portion to be positioned at the second main assembly side positioning portion by the urging force of said urging member.

According to the present invention, a process cartridge and an electrophotographic image forming apparatus in which when the process cartridge is mounted to the main assembly of the apparatus, a first cartridge side portion to be positioned and a second cartridge side portion to be positioned are less frictioned relative to a member or members of the main assembly, can be provided.

According to the present invention, a process cartridge and an electrophotographic image forming apparatus in which when the process cartridge is mounted to the main assembly of the apparatus, a first cartridge side portion to be positioned and a second cartridge side portion to be positioned are less contacted to a member or members of the main assembly, can be provided.

According to the present invention, a process cartridge and an electrophotographic image forming apparatus in which the mounting operativity of the process cartridge relative to the main assembly of the apparatus is improved, can be provided.

According to the present invention, a process cartridge and an electrophotographic image forming apparatus in which the process cartridge can be mounted to the main assembly of the apparatus with the stability, can be provided.

According to the present invention, a process cartridge and an electrophotographic image forming apparatus in which the positioning accuracy of the process cartridge in the main assembly is improved, can be provided.

According to the present invention, a process cartridge and an electrophotographic image forming apparatus in which the positioning accuracy of the process cartridge in the main assembly is stably high, can be provided.

DETAILED DESCRIPTION OF THE PREFERRED EMBODIMENTS

Embodiment 1

Hereafter, the process cartridge (which hereafter will be referred to as "cartridge" and electrophotographic color image forming apparatus (which hereafter will be referred to as "image forming apparatus") in the first of the preferred embodiments of the present invention will be described with reference to the appended drawings.

(General Structure of Image Forming Apparatus)

Figure 1:
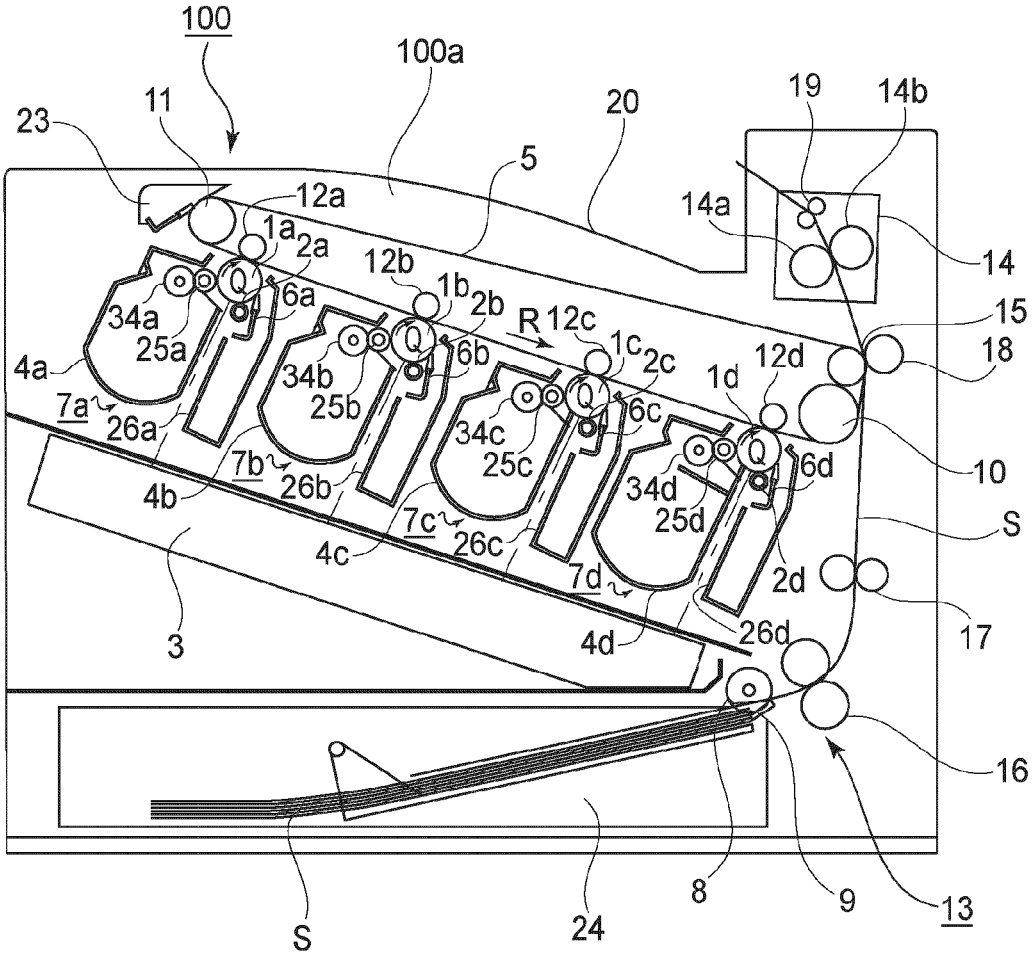
FIG. 1 is a schematic sectional view of the electrophotographic color image forming apparatus in the first of the preferred embodiments of the present invention, showing the general structure of the apparatus.
Figure 3:
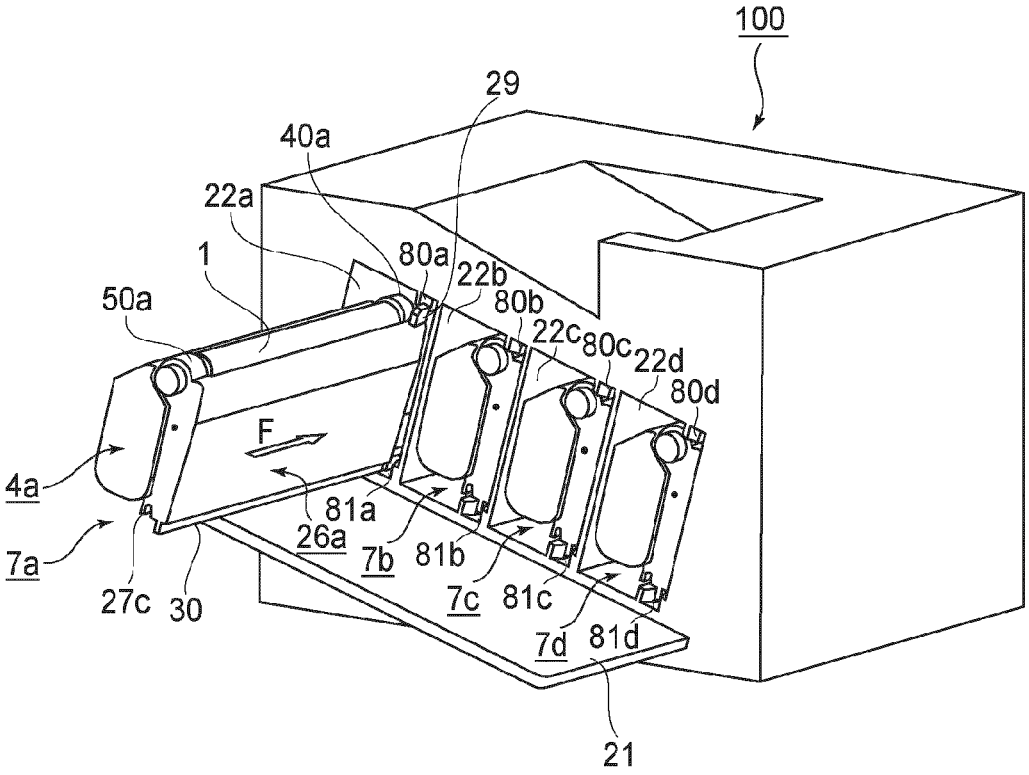
FIG. 3 is a perspective view of the cartridge and image forming apparatus when the former is in the position from which it is mounted into the latter.

First, referring to FIG. 1, the image forming apparatus in this embodiment will be described regarding its general structure. An image forming apparatus 100 shown in FIG. 1 has four cartridge bays 22 (22*a*-22*d*), that is, the spaces into which four cartridges are mountable one for one (FIG. 3). The four cartridge bays 22 are juxtaposed side by side (in parallel), in a single straight row angled relative to the horizontal direction. The cartridge 7 in each cartridge bay 22 (22*a*-22*d*) has one electrophotographic photosensitive drum 1 (1*a*-1*d*).

The electrophotographic photosensitive drum 1 (which hereafter may be referred to as "photosensitive drum") is rotationally driven in the clockwise direction of the drawing, by a driving member (unshown). Each cartridge 7 also has the following processing means, which are disposed in the adjacencies of the peripheral surface of the photosensitive drum 1 in a manner to surround the photosensitive drum 1, in the order in which they will be listed next. They are a cleaning means 6 (6*a*-6*d*), which removes the developer (which hereafter may be referred to as "toner") remaining on the peripheral surface of the photosensitive drum 1 after the transfer, a charge roller 2 (2*a*-2*d*) which uniformly charges the peripheral surface of the photosensitive drum 1, a scanner unit 3 which forms an electrostatic latent image on the peripheral surface of the photosensitive drum 1, by emitting a beam of laser light while modulating the beam of laser light with pictorial information, a development unit 4 (4*a*-4*d*) which develops the electrostatic latent image on the peripheral surface of the photosensitive drum 1 with the use of toner, and an intermediary transfer belt 5 onto which the four toner images on the photosensitive drums, one for one, which are different in color, are sequentially transferred. The photosensitive drum 1, cleaning member 6, charge roller 2, and development unit 4 are integrated in the form of a cartridge (process cartridge), that is, the cartridge 7, which is removably mountable in the main assembly 100*a* of the image forming apparatus 100 by a user.

The intermediary transfer belt 5 is stretched around a driver roller 10 and a tension roller 11, being thereby supported by them. The main assembly 100*a* of the image forming apparatus 100 is provided with first transfer rollers 12 (12*a*-12*d*), which are on the inward side of the loop which the intermediary transfer belt 5 forms. The first transfer rollers 12 are positioned so that they oppose the photosensitive drums 1 (1*a*-1*d*), one for one. To the transfer belt 5, transfer bias is applied from a bias applying means (unshown).

After the formation of a toner image on the photosensitive drum 1, the toner image is transferred onto the intermediary transfer belt 5. More specifically, four toner images are formed on the four photosensitive drums 1, one for one. Then, as the four photosensitive drums 1 are further rotated in the direction indicated by an arrow mark Q, and the intermediary transfer belt 5 is rotated in the direction indicated by an arrow mark R, the four toner images are sequentially transferred (first transfer) in layers onto the intermediary transfer belt 5, by the positive bias applied to the first transfer rollers 12. Then, the four layers of toner images on the intermediary transfer belt 5, which are different in color, are conveyed to a second transferring portion 15.

Meanwhile, in synchronism with the progression of the abovementioned image forming operation, a sheet S of recording medium is conveyed by a sheet conveying means made up of a sheet feeding-and-conveying apparatus 13, a pair of registration rollers 17, etc. The sheet feeding-and-conveying apparatus 13 has a sheet feeder cassette 24 in which multiple sheets S are storable, a sheet feeder roller 8 which conveys the sheet S, and a pair of sheet conveying rollers 16 which conveys further the sheet S after the feeding of the sheet S into the main assembly 100*a* of the image forming apparatus 100. The main assembly 100*a* is structured so that the sheet feeder cassette 24 can be pulled out of the main assembly 100*a* in the frontward direction of the main assembly 100*a*, in FIG. 1. The sheets S in the sheet feeder cassette 24 are kept pressed by the sheet feeder roller 8, and fed into the main assembly 100*a* by the sheet feeder roller 8, while being separated one by one by a sheet separator pad 9 (friction-based sheet separating method).

After being fed into the main assembly 100*a* from the sheet feeding apparatus 13, the sheet S is conveyed to the second transfer portion 15 by the pair of registration rollers 17. In the second transfer portion 15, positive bias is applied to the second transfer roller 18, whereby the four toner image on the intermediary transfer belt 5, which are different in color, are transferred (second transfer) onto the sheet S as the sheet S is conveyed through the second transfer portion 15.

A fixing portion 14 as a fixing means is a portion of the image forming apparatus, which fixes the toner images on the sheet S by applying heat and pressure. A fixation belt 14*a* is cylindrical, and is guided by a belt guiding member (unshown) having a heat generating means, such as a heater, bonded to the belt guiding member. The fixation belt 14*a* and a pressure application roller 14*b* are kept pressed against with each other by the application of a preset amount of pressure thereto, forming thereby the fixation nip.

After the transfer of the toner images (unfixed toner images) onto the sheet S from the image forming portion, the sheet S is conveyed to the fixing portion 14, and then, is conveyed through the fixation nip between the fixation belt 14*a* and pressure application roller 14*b* in the fixing portion 14. As the sheet S is conveyed through the fixation nip, the sheet S and the toner images thereon are subjected to heat and pressure. As a result, the unfixed toner images on the sheet S become fixed to the sheet S. Thereafter, the sheet S having the fixed toner images is discharged into a delivery tray 20 by a pair of sheet discharging rollers 19.

Meanwhile, the toner remaining on the peripheral surface of the photosensitive drum 1 after the toner image transfer is removed by the cleaning member 6. Then, the removed toner is recovered into a chamber for the recovered toner, which is in the photosensitive member unit 26 (26*a*-26*d*).

As for the toner remaining on the intermediary transfer belt 5 after the transfer (second transfer) of the toner images onto the sheet S, it is removed by a transfer belt cleaning apparatus 23. The removed toner is recovered into a waste toner container (unshown) located in the rear portion of the image forming apparatus, through the waste toner passage (unshown).

(Cartridge)

Figure 2:
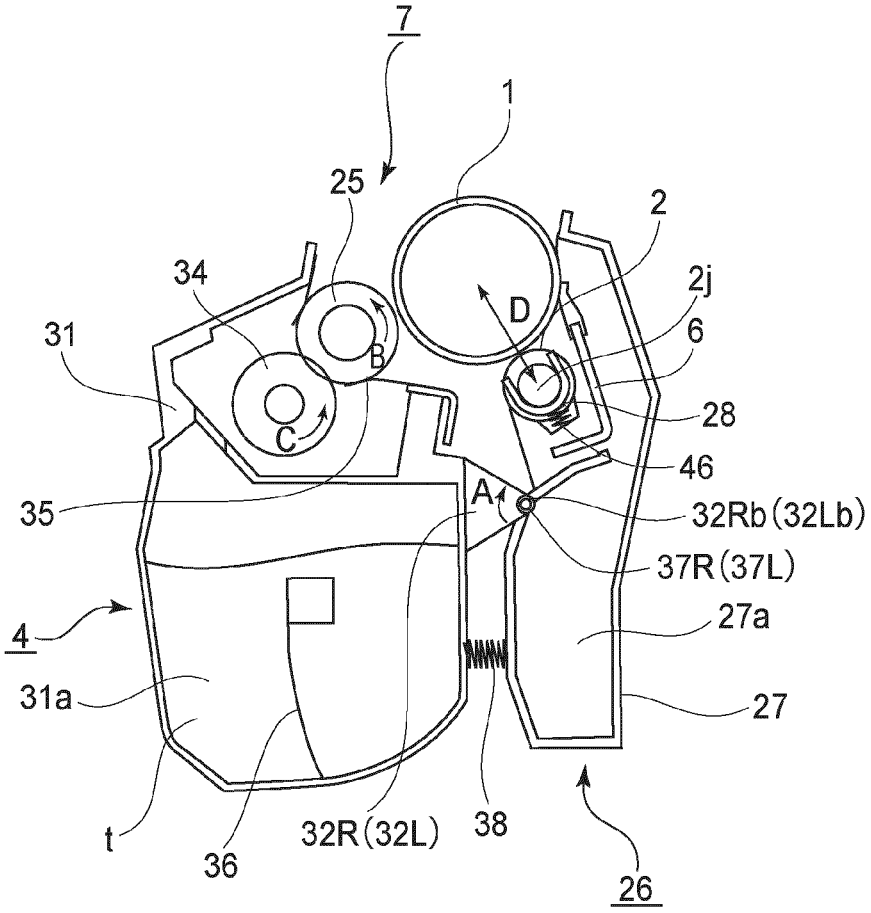
FIG. 2 is a cross-sectional view of the cartridge, showing the general structure of the cartridge.

Next, referring to FIG. 2, the cartridge in this embodiment will be described. FIG. 2 is a cross-sectional view of the cartridge 7, in which a substantial amount of toner t is present. Incidentally, a cartridge 7*a*, that is, a cartridge in which the toner t of yellow color is present, a cartridge 7*b*, that is, a cartridge in which the toner t of magenta color is present, a cartridge 7*c*, that is, a cartridge in which the toner t of cyan color is present, and a cartridge 7*d*, that is, a cartridge in which the toner t of black color is present, are the same in structure.

Each cartridge 7 is made up of a photosensitive member unit 26 and a development unit 4. The photosensitive member unit 26 is provided with the photosensitive drum 1, charge roller 2 (charging means), and cleaning member 6 (cleaning means). The development unit 4 has a development roller 25.

The photosensitive drum 1 is rotatably supported by the cleaning means frame 27 of the photosensitive member unit 26, with the interposition of a pair of bearings which will be described later. In an image forming operation, the photosensitive drum 1 is rotationally driven, by transmitting to the photosensitive member unit 26 the driving force from a motor (unshown). There are the charge roller 2 and cleaning member 6 in the adjacencies of the peripheral surface of the photosensitive drum 1 as described above. As the above described transfer residual toner is removed from the peripheral surface of the photosensitive drum 1 by the cleaning member 6, the removed toner falls into a chamber 27*a* for the removed toner. The cleaning means frame 27 is also provided with a pair of charge roller bearings 28, which are attached to the cleaning means frame 27 in such a manner that the charge roller bearings 28 are movable in the direction indicated by a double-headed arrow mark D, which connects the centers of the charge roller 2 and photosensitive drum 1. The shaft 2*j* of the charge roller 2 is rotatably supported by the charge roller bearings 28, and the bearings 28 are kept pressured toward the photosensitive drum 1 by a pair of charge roller pressing members 46.

The development unit 4 has the development roller 25 and a developing means frame 31. The development roller 25 rotates in contact with the photosensitive drum 1 in the direction indicated by the arrow mark B. The development roller 25 is rotatably supported by a developing means frame 31. More specifically, the development roller 25 is supported by a pair of bearing members 32 (32R and 32L) attached to the lengthwise ends of the developing means frame 31. The development unit 4 is provided with a toner supply roller 34 and a development blade 35. The toner supply roller 34 rotates in contact with the development roller 25 in the direction indicated by an arrow mark C. The development blade 35 is for regulating in thickness the toner layer on the peripheral surface of the development roller 25. Further, the development unit 4 has a toner conveying member 36 for conveying the toner in the toner storage portion 31*a* of the development unit 4 to the toner supply roller 34 while stirring the toner. The toner conveying member 36 is in the toner storage portion 31*a*.

The development unit 4 is connected to the photosensitive member unit 26. More specifically, a pair of pins 37 (37R and 37L) are put through, one for one, the holes 32Rb and 32Lb of the bearing members 32R and 32L, respectively, so that the development unit 4 is pivotally movable relative to the photosensitive member unit 26 about the pins 37 (37R and 37L). The development unit 4 is under the pressure from pressure application springs 38. Therefore, when the cartridge 7 is used for image formation in the main assembly of the image forming apparatus, the development unit 4 rotates about the pins 37 in the direction indicated by an arrow mark A, placing thereby the development roller 25 in contact with the photosensitive drum 1.

(Structure of Means for Mounting Cartridge into Main Assembly of Image Forming Apparatus)

Next, referring to FIG. 3, the portion of the cartridge, which allows the cartridge to be removably mounted into the main assembly of the image forming apparatus, and the portion of the main assembly of the image forming apparatus, which allows the cartridge to be removably mounted into the main assembly of the image forming apparatus, will be described regarding their structures.

FIG. 3 is a perspective view of the cartridge and image forming apparatus when the former is in the position from which it is mounted into the latter. Incidentally, in this embodiment, the cartridge and the main assembly 100*a* of the image forming apparatus 100 are structured so that the former is inserted into the latter, in the front-to-rear direction, that is, the direction indicated by an arrow mark F, which is parallel to the axial line of the photosensitive drum 1, so that the cartridge 7 can be removably mounted into the main assembly 100*a*.

Referring to FIG. 3, the main assembly 100*a* is provided with a cover 21 (front cover), which is on the front side of the main assembly 100*a*. The front cover 21 can be opened or closed. Opening the front cover 21 exposes the four cartridge bays 22 (22*a*-22*d*), which are for the cartridges 7 (7*a*-7*d*), one for one. The four cartridge bays 22 are juxtaposed side by side (in parallel), in a singe straight row angled relative to the horizontal direction. The main assembly 100*a* is provided with top cartridge guides 80 (80*a*-80*d*) as first cartridge guides of the main assembly 100*a*, and bottom cartridge guides 81 (81*a*-80*d*) as second cartridge guides of the main assembly 100*a*. The top and bottom cartridge guides 80 and 81 are located at the top and bottom of the four cartridge bays 22, one for one, and extend from the front to rear of the main assembly 100*a*. The photosensitive member unit 26 of each cartridge 7 is provided with a projection 29 (first portion by which cartridge is guided), and a tongue-like portion 30 (second portion by which cartridge guided) by which the cartridge 7 is guided when the cartridge 7 is mounted into, or removed from, the corresponding cartridge bay 22. More specifically, in order to mount the cartridge 7 into the corresponding cartridge bay 22, the projection 29 and tongue-like portion 30 of the photosensitive member unit 26 are to be fitted in the cartridge guides 80 and 81 of the main assembly 100*a*, respectively, and then, the cartridge 7 is to be pushed into the cartridge bay in the direction indicated by an arrow mark F in the drawing.

Incidentally, the abovementioned projection 29 (first portion of cartridge 7, by which cartridge 7 is guided) is located at the top of the leading end of the cartridge 7, in terms of the direction in which the cartridge 7 is inserted into the main assembly 100*a*, whereas the tongue-like portion 30 (second portion of cartridge 7, by which cartridge 7 is guided) is on the bottom surface of the cartridge 7, and extends from the leading end to the trailing end.

Each cartridge 7 is also provided with a pair of cartridge positioning portions 40*a* and 50*a* (by which cartridge 7 is positioned relative to main assembly 100*a*), which are located at the leading and trailing ends of the cartridge 7, in terms of the abovementioned cartridge insertion direction. The operation to mount the cartridge 7 into the main assembly 100*a* concludes as the cartridge 7 becomes correctly positioned in the main assembly 100*a*. Incidentally, for the purpose of controlling the rotation of the cartridge 7, which occurs as driving force is transmitted to the cartridge 7, the leading end of the cartridge 7 is provided with a shaft 27*b* (FIG. 4), which protrudes in the direction parallel to the cartridge mounting direction (cartridge insertion direction), whereas the trailing end of the cartridge 7 is provided with a groove 27*c*, which is U-shaped in cross section. As the cartridge 7 becomes correctly positioned in the main assembly 100*a*, the shaft 27*b* fits into a hole 82*b* (FIG. 5) of the main assembly 100*a*, which is elongated in cross section, and the shaft 92*c* (FIG. 5) of the main assembly 100*a* fits into the groove 27*c* of the cartridge 7.

In terms of the direction in which the cartridge 7 advances as it is inserted into the main assembly 100*a*, the projection 29 (by which cartridge 7 is guided) of the cartridge 7 is located at the top of the leading end of the cartridge 7, as described above. The tongue-like portion 30 of the cartridge 7 is on the bottom surface of the cartridge 7, extending from the leading end of the cartridge 7 to the trailing end of the cartridge 7. Further, in terms of the direction perpendicular to the axial line of the photosensitive drum 1, the tongue-like portions 29 and 30 are on the same side of the photosensitive drum 1.

Therefore, it is ensured that the cartridge 7 reliably advances into the main assembly 100*a*.

As for the structural arrangement for correctly positioning the cartridge 7 in the main assembly 100*a*, it will be described later in detail.

(Structure for Correctly Positioning Cartridge, and Structure for Pressing Cartridge)

Next, referring to FIGS. 4-7, the structural arrangement, in this embodiment, for correctly positioning the cartridge relative to the main assembly 100*a*, and the structural arrangement for pressing the cartridge to correctly positioning the cartridge, will be described.

Figure 4:
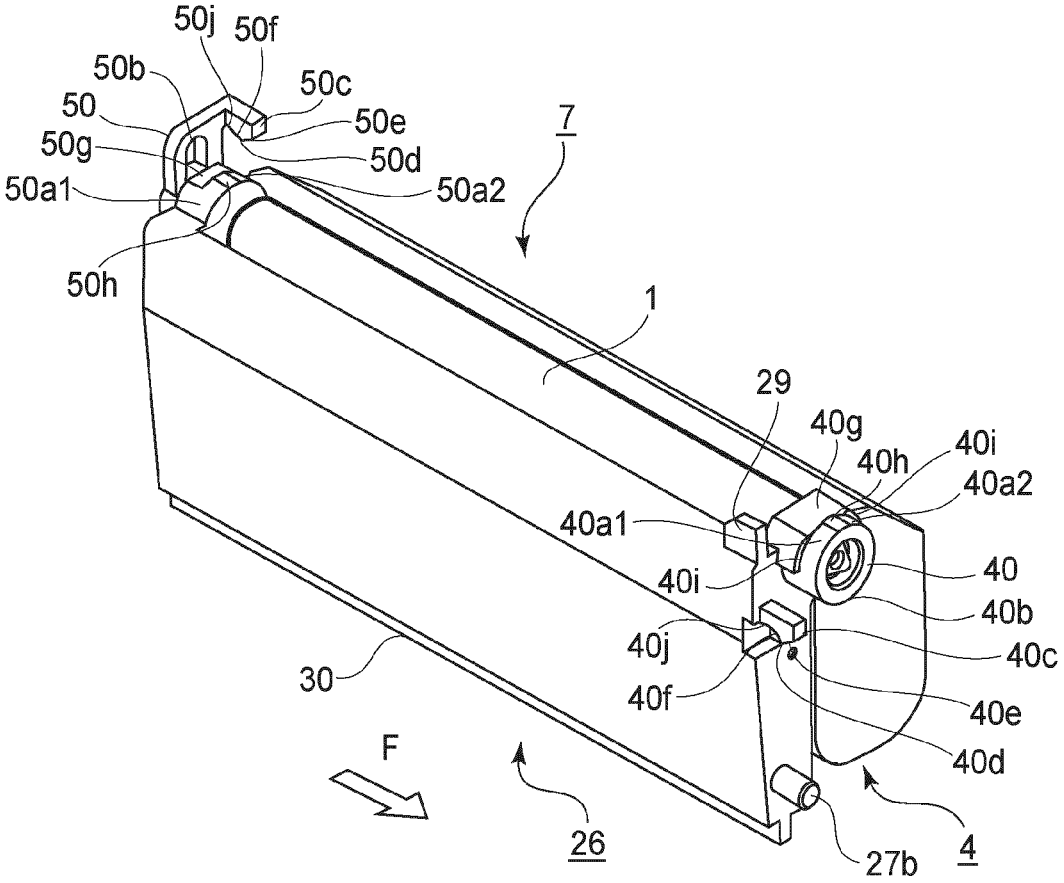
FIG. 4 is an external perspective view of the process cartridge.

FIG. 4 is an external perspective view of the cartridge in this embodiment. The photosensitive drum 1, which the cartridge 7 has, is rotatably supported, by the lengthwise end portions of its shaft (unshown), by a pair of bearings 40 and 50, one for one, which are solidly attached to the cleaning means frame 27.

The bearing 40 (first bearing which supports one of lengthwise ends of shaft of photosensitive drum 1) is the bearing on the rear side, that is, the leading end side in terms the direction in which the cartridge 7 is made to advance in the main assembly 100*a* when it is mounted into the main assembly 100*a*. It is provided with a cartridge positioning first portions 40*a* (40*a*1, 40*a*2), which are two portions of the top side of the peripheral surface of the bearing 40*a*. More specifically, the cartridge positioning first portion 40*a* (which is made up of portions 40*a*1 and 40*a*2) is for correctly positioning the leading end of the cartridge 7 relative to the main assembly 100*a*, in terms of the direction vertical to the abovementioned cartridge advancement direction. It is arcuate in cross section. Incidentally, in terms of the cartridge advancement direction, the bearing 40, that is, the bearing which will be at the deepest end of the cartridge bay, is located at the downstream end of the cartridge 7 (FIG. 4). The cartridge 7 is also provided with a pressure catching portion 40*b*, which catches the pressure applied to the cartridge 7 by the cartridge pressing member 83 (which may be referred to as pressure applying member, or upwardly pushing member), which is a portion of the bottom side of the peripheral surface of the cartridge positioning first portion 40*a*. Incidentally, the above-mentioned cartridge advancement direction is the direction in which the cartridge 7 is advanced into the main assembly 100*a* when a user mounts the cartridge 7 into the main assembly 100*a*.

Figure 15:
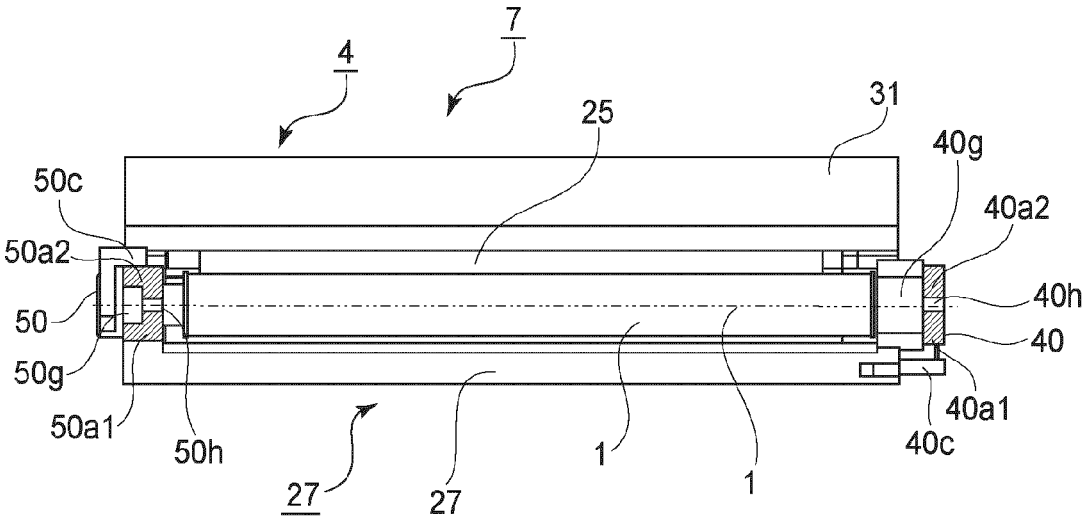
FIG. 15 is a sectional view of the cartridge, at a horizontal plane which coincides with the axial line of the photosensitive drum, as seen from above.

Further, the abovementioned cartridge positioning portions 40*a* (40*a*1 and 40*a*2) is positioned so that it straddles the axial line I of the photosensitive drum 1 (FIG. 15). That is, the cartridge 7 has the cartridge positioning first portion 40*a*1, which is on one side of the axial line I of the photosensitive drum 1, and the cartridge positioning second portion 40*a*2, which is on the other side of the axial line I of the photosensitive drum 1. The cartridge positioning first portion 40*a*1 (positioning portion on leading end side) is on the opposite side of the abovementioned axial line I from the cartridge positioning second portion 40*a*2 (positioning portion on trailing end side) (FIG. 15). As for the abovementioned pressure catching portion 40*b*, it is on the downstream side of the photosensitive drum 1 in terms of the cartridge advancement direction. As seen from the direction J (FIG. 9(*c*)) in which upward pressure is applied by the abovementioned pressing member 83 (pressure applying member, upwardly pushing member), the pressure catching portion 40*b* is (roughly at the mid point) between the cartridge positioning first and second portions 40*a*1 and 40*a*2. Therefore, as the pressure catching portion 40*b* is pressed, the cartridge positioning portion 40*a* is reliably pressed upon the cartridge catching portion 82*a* (cartridge positioning first portion on main assembly side), being thereby correctly positioned relative to the main assembly 100*a*. Incidentally, in this embodiment, the cartridge 7 is provided with the cartridge positioning first and second portions 40*a*1 and 40*a*2 as the cartridge positioning portions on the leading end side. Therefore, it is ensured that the cartridge 7 is more reliably pressed upon the cartridge catching (pressure catching) portion 82*a* of the main assembly 100*a*. However, the number of the cartridge positioning portions with which the leading end of the cartridge 7 is provided may be only one, as long as it is properly positioned.

Further, the cartridge 7 is provided with a pushing member 40*c*, which is the first pushing member for moving the pressing member 83 into its retreat. With reference to the center of the cartridge 7, in terms of the horizontal direction perpendicular to the abovementioned cartridge advancement direction, the pushing portion 40*c* is located closer to the lengthwise end wall of the cartridge 7 than the pressure catching portion 40*b*. The pushing portion 40*c* is protruding downstream from the downstream end wall of the cartridge 7 in terms of the cartridge advancement direction, and its end portion is provided with a projection 40*d* which is projecting downward. More specifically, the projection 40*d* of the pushing portion 40*c* is tapered, providing thereby gently slanted surfaces 40*e* and 40*f*, that is, the slanted surfaces on the downstream and upstream sides, respectively, which are slanted so that their intersection is the peak of the projection 40*d* (projection 40*d*).

Further, the bearing 40, that is, the bearing on the rear side, is provided with a first contact portion 40*h* (cartridge movement regulating first portion of cartridge), which protrudes further upward than the cartridge positioning portion 40*a*. The first contact portion 40*h* is flat across the top surface (end surface), and is between one end of the cartridge positioning first portion 40*a*1 and the other end of the cartridge positioning second portion 40*a*2. That is, the first contact surface 40*h* is between the cartridge positioning first and second portions 40*a*1 and 40*a*2; the cartridge positioning first portion 40*a*1 is located next to one end of the first contact surface 40*h*, and the cartridge positioning second portion 40*a*2 is located next to the other end of the first contact surface 40*h*. Located on the upstream of the first contact surface 40*h* in terms of the cartridge mounting direction is a surface 40*g*, which is closer to the axial line of the photosensitive drum 1 than the top surface of the first contact surface 40*h*. Further, the bearing 40, that is, the bearing on the rear end, is provided with a contact surface 40*i*, which is the surface for correctly positioning the cartridge 7 in terms of the lengthwise direction of the cartridge 7. Incidentally, as the cartridge 7 is mounted into the main assembly 100*a*, the contact surface 40*i* comes into contact with the inward surface of the rear lateral panel of the main assembly 100*a*, ensuring that the cartridge 7 is correctly position in terms of the lengthwise direction of the cartridge 7.

Figure 5:
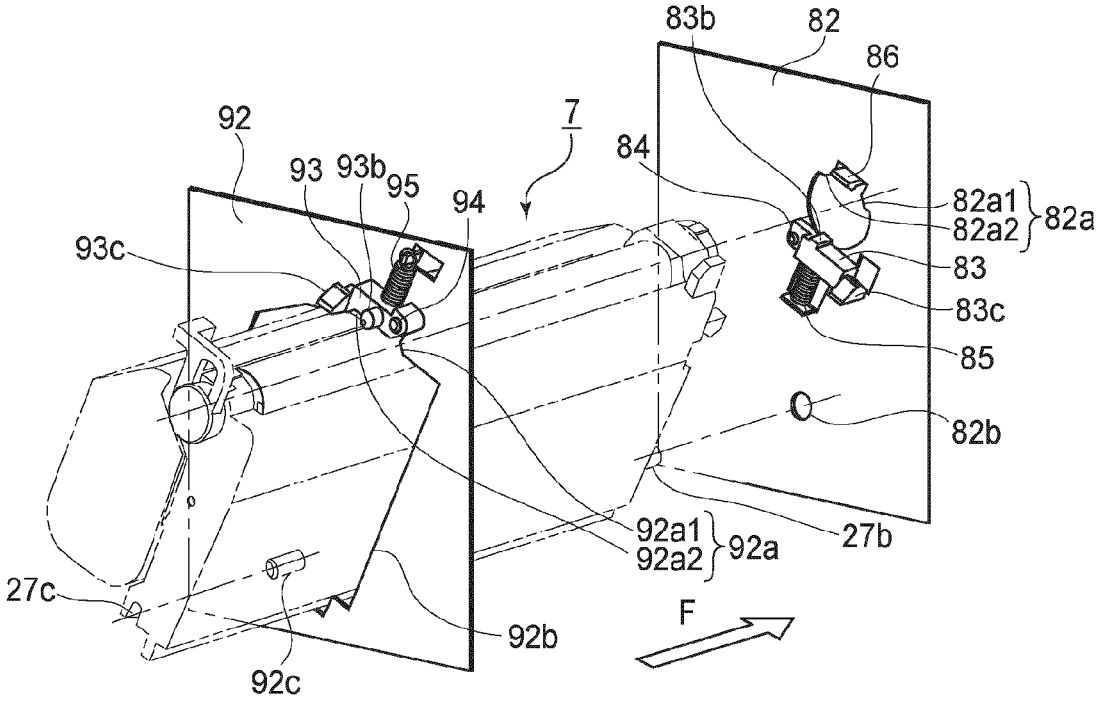
FIG. 5 is a schematic drawing of the cartridge positioning portion of the main assembly of the image forming apparatus, and the cartridge pressing portion of the main assembly of the image forming, showing their structures.

Next, the bearing 50 (second bearing, that is, bearing which supports other end of photosensitive drum 1 in terms of direction parallel to axial line of photosensitive drum 1) will be described. The bearing 50 is the bearing on the front side, that is, the trailing side in terms of the abovementioned cartridge advancement direction. The bearing 50, that is, the bearing on the front side, is provided with cartridge positioning second portions 50*a* (50*a*1 and 50*a*2), which are two portions of the top side of the peripheral surface of the bearing 50. More specifically, the cartridge positioning second portions 50*a* (portions 50*a*1 and 50*a*2) are for correctly positioning the front end of the cartridge 7 relative to the main assembly 100*a*, in terms of the direction perpendicular to the abovementioned cartridge advancement direction. They are arcuate in cross section. The cartridge 7 is also provided with an upward pressure catching portion 50*b*, which catches the pressure applied to the cartridge 7 by an upwardly pulling member 93 (FIG. 5). The pressure catching portion 50*b* is located farther from the axial line of the bearing 50*a* than the cartridge positioning first portion 50*a*.

As described above, the cartridge 7 has the first bearing 40, which supports one of the lengthwise end portions of the photosensitive drum 1 in terms of the direction parallel to the axial line of the photosensitive drum 1. The contact surface 40*h* and cartridge positioning first portions 40*a* (40*a*1 and 40*a*2) are portions of the peripheral surface of the first bearing 40. Further, the cartridge 7 has the second bearing 50 which supports the other lengthwise end of the photosensitive drum 1 in terms of the direction parallel to the axial line of the photosensitive drum 1. The contact portion 50*h* (contact surface) and cartridge positioning second portions 50*a* are portions of the peripheral surface of the second bearing 50.

Therefore, it is ensured that the cartridge 7 is precisely positioned relative to the main assembly 100*a*.

Incidentally, like the cartridge positioning portion 40*a*, that is, the cartridge positioning portion on the rear side, the cartridge positioning portion 50*a* has a cartridge positioning portion (cartridge positioning third portion 50*a*1), which is on one side of the axial line of the photosensitive drum 1, and a cartridge positioning portion (cartridge positioning fourth portion 50*a*2), which is on the other side of the axial line of the photosensitive drum 1. The cartridge positioning third portion 50*a*1 (positioning portion on leading end side) is on the opposite side of the abovementioned axial line I from the cartridge positioning fourth portion 50*a*2 (positioning portion on trailing end side) (FIG. 15). As for the abovementioned pressure catching portion 50*b*, it is on the downstream side of the photosensitive drum 1 in terms of the cartridge advancement direction. As seen from the direction K (FIG. 11(*c*)) in which upward pressure is applied by the abovementioned upwardly pulling member 93 (pressure applying member, upwardly pushing member), the pressure catching member 50*b* is (roughly at the mid point) between the cartridge positioning third and fourth portions 50*a*1 and 50*a*2. Therefore, as the pressure catching portion 50*b* is pressed, the cartridge positioning portions 50*a* are reliably pressed upon the pressure catching portion 92*a*, being thereby correctly positioned relative to the main assembly 100*a*.

Incidentally, in this embodiment, the cartridge 7 is provided with the cartridge positioning third and fourth portions 50*a*1 a 50*a*2 as the cartridge positioning portions on the trailing end side. Therefore, it is ensured that the cartridge 7 is more reliably pressed upon the pressure catching portions 92*a* of the main assembly 100*a*. However, the number of the cartridge positioning portions which the trailing end of the cartridge 7 is provided may be only one, as long as it is properly positioned.

Further, the cartridge 7 is provided with a pushing member 50*c*, which is the second pushing member for moving the upwardly pulling member 93 into its retreat. With reference to the center of the cartridge 7, in terms of the direction which is horizontal and perpendicular to the abovementioned cartridge advancement direction, the pushing portion 50*c* is located closer to the lengthwise end wall of the cartridge 7 than the pressure catching portion 50*b*. The pushing portion 50*c* is protruding downstream from the main portion of the bearing 50 in terms of the cartridge advancement direction, and its end portion is provided with a projection 50*d* which is projecting downward. More specifically, the projection 50*d* is tapered, providing thereby gently slanted surfaces 50*e* and 50*f*, that is, the slanted surfaces on the downstream and upstream sides, respectively, which are slanted in such a manner that their intersection is the peak of the projection 50*d* (projection 50*d*). Further, the bearing 50, that is, the bearing on the front side, is provided with a second contact portion 50*h* (contact surface, which serves as cartridge movement regulating portion), which protrudes further upward than the cartridge positioning portion 50*a*. The second contact portion 50*h* is flat across the top surface (second contact surface), and is between one end of the cartridge positioning third portion 50*a*1 and the other end of the cartridge positioning fourth portion 50*a*2. That is, the second contact surface 50*h* is between the cartridge positioning third and fourth portions 50*a*1 and 50*a*2; the cartridge positioning third portion 50*a*1 is located next to one end of the second contact surface 50*h*, and the cartridge positioning fourth portion 50*a*2 is located next to the other end of the second contact surface 50*h*. Located on the upstream of the contact surface 50*h* in terms of the cartridge mounting direction is a surface 50*g*, which is closer to the axial line of the photosensitive drum 1 than the top surface of the first contact portion 50*h*.

Further, in terms of the direction perpendicular to the axial line of the photosensitive drum 1, the top surface (area of first contact) of the contact portion 40*h* is different in position from the cartridge positioning first portions 40*a* (40*a*1 and 40*a*2). Also in terms of the direction perpendicular to the axial line of the photosensitive drum 1, the top surface (area of second contact) is different in position from the cartridge positioning second portions 50*a* (50*a*1 and 50*a*2).

Further, in terms of the above-mentioned cartridge advancement direction, the top surface (area of first contact) of the first contact portion 40*h* is on the leading end side, and the top surface (area of second contact) of the second contact portion 50*h* is on the trailing end side.

Therefore, it is ensured that the cartridge 7 is precisely positioned relative to the main assembly 100*a*.

Further in terms of the direction perpendicular to the axial line of the photosensitive drum 1, the top surface of the contact surface 40*h* is between one end of the cartridge positioning portions 40*a* (40*a*1 and 40*a*2) and the other end of the cartridge positioning portions 40*a* (40*a*1 and 40*a*2). Also in terms of the direction perpendicular to the axial line of the photosensitive drum 1, the top surface (area of contact) of the second contact portion 50*h* is between one end of the cartridge positioning second portions 50*a* (50*a*1 and 50*a*2) and the other.

Therefore, it is ensured that the cartridge 7 is precisely positioned relative to the apparatus main assembly 100*a*.

Figure 6:
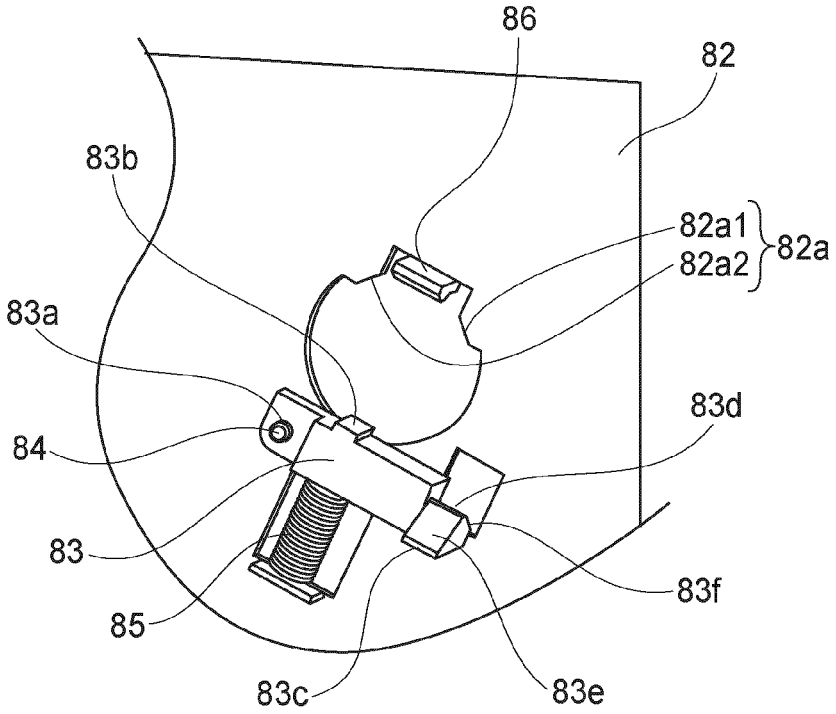
FIG. 6 is a detailed view of the cartridge positioning mechanism and cartridge pressing mechanism, on the rear side, of the main assembly of the image forming apparatus, showing their structures.
Figure 7:
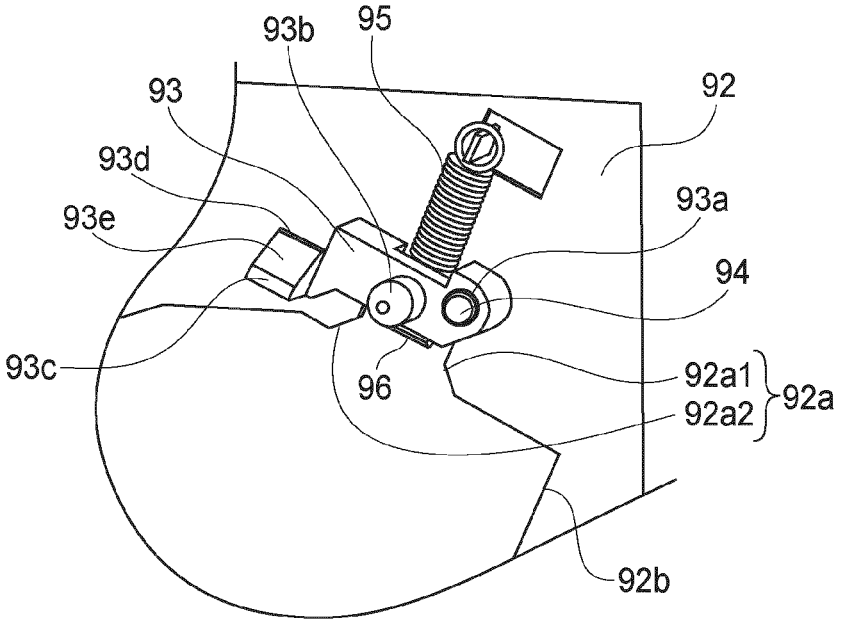
FIG. 7 is a detailed view of the cartridge positioning mechanism and cartridge pressing mechanism, on the front side, of the main assembly of the image forming apparatus, showing their structures.

Next, the structure of the cartridge positioning portion of the main assembly 100*a*, and the cartridge pressing mechanism of the main assembly 100*a*, will be described. FIG. 5 is a schematic drawing for describing the structure of the cartridge positioning portion of the main assembly 100*a* of the image forming apparatus 100, and the cartridge pressing mechanism of the main assembly 100*a*, and show the structures thereof. FIG. 6 is a detailed drawing of the cartridge positioning portion and cartridge pressing mechanism, on the rear side, and shows the structures thereof. FIG. 7 is a detailed drawing of the cartridge positioning portion and cartridge pressing mechanism, on the front side, and shows the structures thereof.

Referring to FIG. 5, the main assembly 100*a* is provided with a rear lateral panel 82, which is on the leading end side, in terms of the cartridge mounting direction, and a front lateral panel 92, which is on the trailing end side. The lateral panel 92 is provided with a hole through which the cartridge 7 is removably mountable in the cartridge bay 22. The cartridge 7 is inserted into the main assembly 100*a* through this hole. Further, the cartridge 7 is inserted into the cartridge bay 22 in the direction of the arrow mark F, along the above described cartridge guiding top guide 80 and cartridge guiding bottom guide 81 (FIG. 3).

The lateral plate 82 is provided with two cartridge catching portions 82*a* (82*a*1 and 82*a*2), that is, the first portions of the main assembly, which are for correctly positioning the cartridge 7 relative to the main assembly in terms of the direction perpendicular to the direction (advancement direction) in which the cartridge 7 is mounted. The lateral plate 82 is also provided with the pressing member 83, which is for pressing the cartridge 7 toward the cartridge catching portion 82*a* by being under the pressure applied thereto by the resiliency (elastic force) of a compression spring 85. This pressing member 83 functions as an upwardly pushing member which keeps the cartridge 7 pressed upward by being pressed upward by the pressure applied by the compression spring 85.

The pressing member 83 is located under the cartridge catching portion 82*a*. It is attached to the lateral plate 82. More specifically, a shaft 84 solidly fixed to the lateral plate 82, that is, the lateral plate on the rear side, of the main assembly, is put through the through hole 83*a*, the axial line of which coincides with the pivotal axis of the pressing member 83, so that the pressing member 83 is enabled to take the cartridge pressing position in which it keeps the cartridge 7 pressed on the cartridge catching portions 82*a*, position in its retreat in which it does not press on the cartridge 7, and the standby position in which it remains in the path of the cartridge 7.

Further, the pressing member 83 is provided with a cartridge pushing portion 83*b*, by which the pressing member 83 pushes the cartridge when the pressing member 83 is in the cartridge pressing position. The cartridge pushing portion 83*b* corresponds in position to the pressure catching portion 40*b* of the cartridge 7. The pressing member 83 is also provided with a pressure catching first portion 83*c* for moving the pressing member 83 into the retreat. The pressure catching first portion 83*c* corresponds in position to the pushing portion 40*c* of the cartridge 7. The pressure catching first portion 83*c* is provided with an upward projection 83*d*. The upward projection 83*d* is provided with gently slanted surfaces 83*e* and 83*f*, which are the upstream and downstream surfaces of the projection 83*d*, respectively, in terms of the cartridge mounting direction. The surfaces 83*e* and 83*f* are slanted so that the joint between the two surfaces is the peak of the projection 83*d*. Further, in terms of the direction perpendicular to the cartridge mounting direction, the pressure catching portion 83*c* is located further outward (in terms of the radium direction of hole 83*a*) from the axial line of the hole 83*a* than the cartridge pushing portion 83*b*. That is, in terms of the lengthwise direction of the pressing member 83, the abovementioned axial line of the hole 83*a*, cartridge pressing portion 83*b*, and pressure catching portion 83*c*, are positioned in the listed order.

The lateral plate 82 is provided with a cartridge movement regulating first portion 86 (cartridge movement regulating first portion of main assembly) which prevents the cartridge 7 from moving upward by the reactive force generated as the cartridge pushes the pressing member 83 into its retreat. The cartridge movement regulating first portion 86 is formed of resin, and is located between the two cartridge catching portions 82*a* (82*a*1 and 82*a*2) of the lateral plate 82.

Referring to FIG. 7, the lateral plate 92 is provided with the cartridge insertion hole 92*b*, and two cartridge catching portions 92*a* (92*a*1 and 92*a*2), which function as the cartridge positioning second portions of the main assembly. The cartridge catching portions 92*a* are two portions of the top portion of the inward surface of the hole 92*b*, and are for correctly positioning the cartridge 7 in terms of the direction perpendicular to the cartridge mounting direction. Further, the lateral plate 92, that is, the frontal lateral plate of the main assembly, is provided with a cartridge pulling member 93 for upwardly pulling the cartridge 7 toward the cartridge catching portions 92*a*, by being under the tensional force generated by a pressure application spring 95, which is a tension spring. The cartridge pulling member 93 is located upward of the cartridge catching portions 92*a*. It is pivotally supported by the lateral plate 92; a shaft 94 solidly attached to the lateral plate 92 is put though a hole 93*a* (whose axial line is rotational axis) of the cartridge pulling member 93. The cartridge pulling member 93 is attached to (supported by) the lateral plate 92 so that it is enabled to take the position in which it keeps the cartridge 7 pressed upon the cartridge catching portions 92*a*, position in its retreat in which it is free from the force from the spring 95, and standby position in which it is in the path of the cartridge 7.

Further, the cartridge pulling member 93 is provided with a cartridge pulling portion 93*b* for pulling the cartridge upward when the cartridge pulling member 93 is in the cartridge pulling position. The cartridge pulling portion 93*b* corresponds in position to the cartridge pulling force catching portion 50*b* of the cartridge 7. The cartridge pulling member 93 is also provided with a cartridge catching second portion 93*c* for moving the cartridge pulling member 93 into its retreat. The cartridge catching second portion 93*c* corresponds in position to the pushing portion 50*c* of the cartridge 7. It is provided with an upward projection 93*d*, which has gently slanted surfaces 93*e* and 93*f* (FIG. 10) slanted so that their intersection is the peak of the upward projection 93*d*.

Further, in terms of the direction perpendicular to the cartridge mounting direction, the cartridge catching portion 93*c* is located further outward from the axial line of the hole 93*a* than the cartridge pulling portion 93*b*. That is, in terms of the lengthwise direction of the cartridge pulling member 93, the hole 93*a*, cartridge pulling portion 93*b*, and cartridge catching portion 93*c* are positioned in the listed order. Further, the lateral plate 92, that is, the frontal lateral plate of the main assembly, is provided a cartridge movement regulating second portion 96, which is for preventing the cartridge 7 from being moved upward by the reactive force which occurs as the cartridge pulling member 93 is pushed into its retreat. The cartridge movement regulating portion 96 is between the abovementioned two cartridge catching portions 92*a* (92*a*1 and 92*a*2).

Incidentally, in this embodiment, on the leading end side of the cartridge 7 in terms of the cartridge mounting direction, the pressure applying member 83 (pressing member, upwardly pushing member) is located below the cartridge catching portion 83*a* to press the cartridge upward from below to cause the cartridge 7 to bump into the cartridge catching portions 82*a*, whereas on the trailing side of the cartridge 7 in terms of the cartridge mounting direction, the cartridge pulling member 93 (cartridge pressing member) is positioned above the cartridge catching portions 92*a* to pull the cartridge 7 upward from above to cause the cartridge to bump into the cartridge catching portions 92*a* which are positioned above the cartridge. That is, as the cartridge 7 is moved into its image forming position in the main assembly 100*a*, the cartridge catching portion 82*a* (portion to be pressed) is pressed by the upward force from the cartridge pushing member 83. Thus, the cartridge positioning first and second portions 40*a*1 and 40*a*2 (cartridge positioning portions of cartridge, on leading end side) are correctly positioned by the cartridge catching portions 82*a* (cartridge positioning first portion of main assembly). Further, the upwardly pulling force catching portion 50*b* is pushed by the upwardly pulling force from the upwardly pulling member 93. Therefore, the cartridge positioning third and fourth portions 50*a*1 and 50*a*2 (cartridge positioning portions of cartridge, on trailing end side) are correctly positioned by the cartridge catching portions 92*a* (92*a*1 and 92*a*2) (cartridge positioning second portions of main assembly). Thus, the employment of this structural arrangement makes it possible to provide the lateral plate 92, that is, the frontal lateral plate of the main assembly, with the hole through which the cartridge 7 can be mounted into the cartridge bay 22. Therefore, the bearing 50, that is, one of the bearings in the adjacencies of the cartridge positioning portion, can be directly pressed. Therefore, the pressure applied to the bearing 50 remains stable. Therefore, the cartridge 7 is precisely positioned and remains precisely positioned. Therefore, the photosensitive drum 1 is precisely placed in contact with the intermediary transfer belt 5, and remains precisely in contact with the belt 5.

Incidentally, this embodiment is not intended to limit the present invention in structural arrangement. That is, the cartridge pressing member 83 and cartridge pulling member 93 may be positioned on the leading and trailing end sides, respectively, as elastically pressing members, in terms of the cartridge mounting direction, or vice versa. In either case, the above described effects can be obtained.

(Operation of Cartridge Pressing Mechanism During Mounting and Removal of Cartridge)

Next, referring to FIGS. 8-11, the operations of the cartridge pressing mechanism during the mounting of the cartridge 7 into the image forming apparatus, and the removal of the cartridge 7 from the image forming apparatus, will be described.

Figure 8:
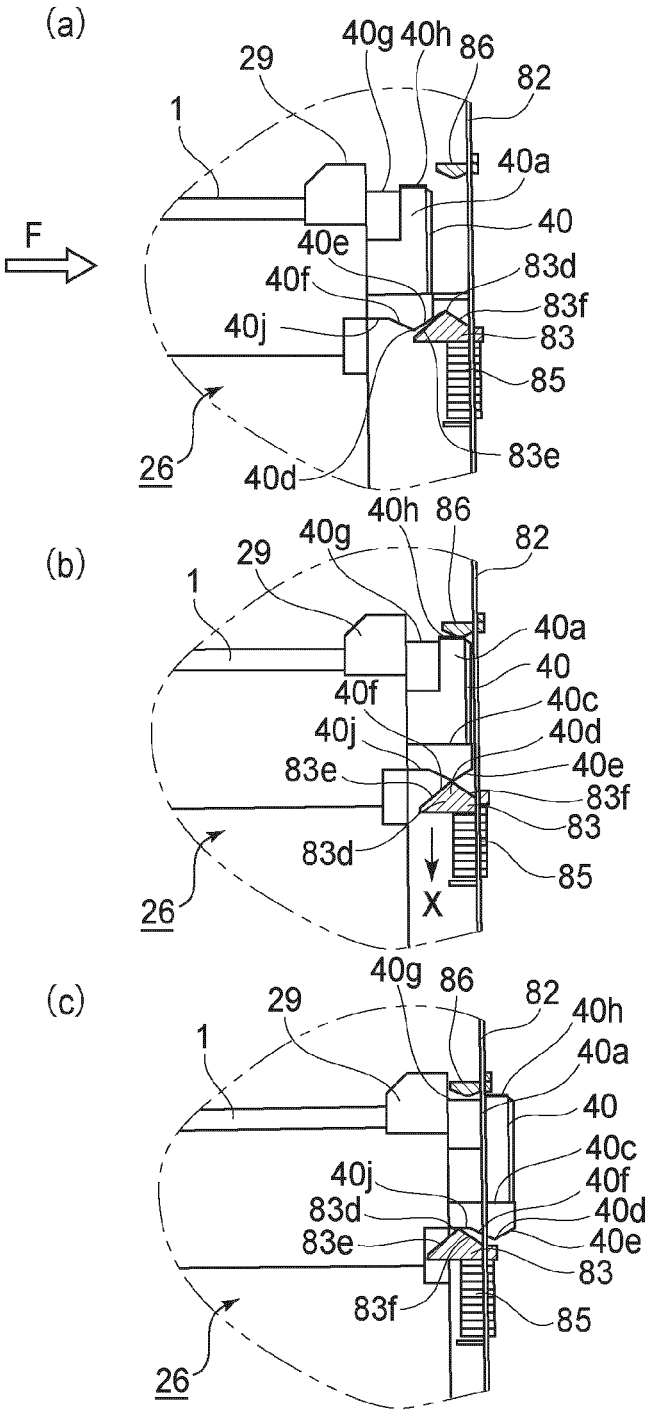
FIG. 8 is a plan view of the cartridge pressing rear mechanism of the main assembly of the image forming apparatus, as seen from the right-hand side (as seen from front side of main assembly), showing the operation of the cartridge pressing mechanism.
Figure 9:
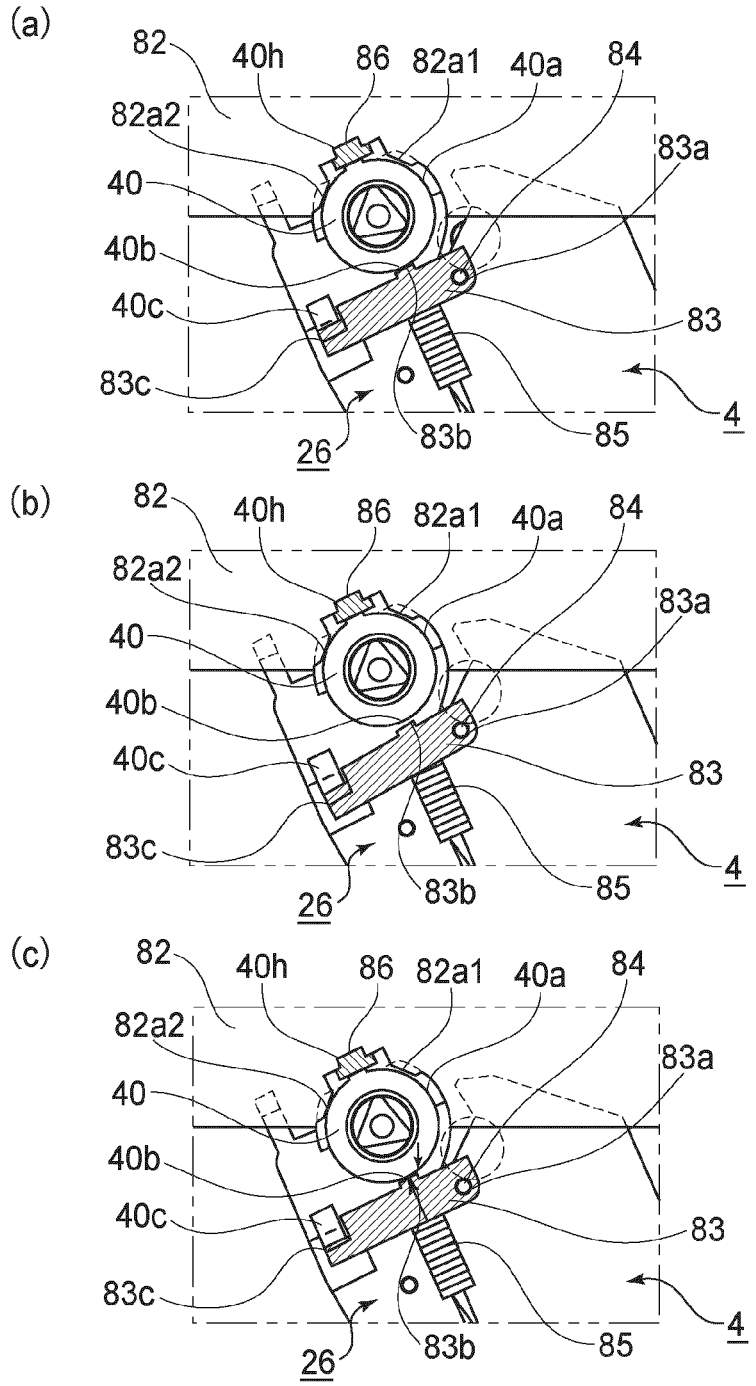
FIG. 9 is a plan view of the cartridge pressing rear mechanism of the main assembly of the image forming apparatus, as seen from the leading end side of the cartridge in terms of the direction in which the cartridge is mounted, showing the operation of the cartridge pressing mechanism.

(a) Leading End Side: Operations of Cartridge Pressing Mechanism During Mounting and Removal of Cartridge FIG. 8 is a plan view of the right-hand side (as seen from front side) of the cartridge pressing rear mechanism of the main assembly. FIG. 9 is a plan view of the rear side of the cartridge pressing rear mechanism (leading end side in terms of cartridge mounting direction) of the main assembly.

The cartridge 7 is to be mounted in the direction indicated by the arrow mark F as described before. Referring to FIGS. 8(*a*) and 9(*a*), as the cartridge 7 is inserted, the slanted surface 40*e* of the pushing portion 40*c* of the bearing 40, that is, the rear bearing of the cartridge 7, comes into contact with the slanted surface 83*e* of the cartridge catching portion 83*c* (standby position). Then, as the cartridge 7 is inserted further, the pressing member 83 is gradually pushed down, causing the projection 40*d* of the pushing portion 40*c* to come into contact with the projection 83*d* of the cartridge catching portion 83*c*, as shown in FIG. 8(*b*). Consequently, the pressing member 83 retreats in the direction indicated by an arrow mark X (position in retreat).

More specifically, the pressing member 83 moves into the position in its retreat, in which its pressing portion 83*b* does not contact the pressure catching portion 40*b* of the cartridge 7, as shown in FIG. 9(*b*). Therefore, while the cartridge 7 is mounted, the pressure catching portion 40*b* is not subjected to any pressure. The pressure which the cartridge 7 receives from the pressing member 83 when it is mounted is removed by the pushing portion 40*c*, which is located further from the hole 83*a*. That is, the amount of force necessary to push down the pressing member 83 against the force which acts to upwardly push the cartridge 7 is reduced by the ratio between the distance from the axial line of the hole 83*a* to the pressure catching portion 40*b* (pushing portion 83*b*) and the distance from the axial line of the hole 83*a* to the pushing portion 40*c* (pressure catching portion 83*c*). Therefore, the amount of load to which the cartridge 7 is subjected when it is mounted is substantially smaller than the amount of pressure which the cartridge 7 receives from the pressing member 83; the amount of force required to mount the cartridge 7 is substantially smaller than the amount of the pressure which the cartridge 7 receives from the pressing member 83.

Further, when the cartridge 7 is mounted, the cartridge 7 is subjected to upward force, that is, the reactive force generated as the pressing member 83 is pushed down into its retreat. However, the contacting surface 40*h* comes into contact with the cartridge movement regulating portion 86, that is, the cartridge contacting first portion of the main assembly. Therefore, the cartridge 7 is prevented from moving upward. Here, the cartridge movement regulating portion 86 of the main assembly and the main assembly contacting surface 40*h* are positioned so that they remain in contact with each other until immediately before the cartridge positioning portion 40*a* is correctly positioned by coming into contact with the cartridge catching portion 83. Therefore, while the cartridge 7 is mounted, more specifically, from the moment the cartridge 7 begins to receive the upward pressure from the pressing member 83 until immediately before the cartridge 7 is correctly positioned, the cartridge movement regulating portion 86, that is, the cartridge regulating portion of the main assembly, which is formed of resin, and the contacting surface 40*h*, slide on each other, and therefore, the cartridge positioning portion 40*a* does not rub against the cartridge catching portion 82*a* of the main assembly, which is formed of a thin sheet of steel or the like. Therefore, the problem that the cartridge positioning portion 40*a* is shaved by the cartridge catching portion 82*a* is prevented.

As the cartridge 7 is inserted even further, the cartridge catching portion 83*c* is disengaged from the pushing portion 40*c*, and therefore, the pressing member 83 gradually returns to its pressing position from the retreat. Then, the cartridge 7 is inserted far enough for the contacting surface 40*i*, which is for correctly positioning the cartridge 7 in terms of the lengthwise direction of the cartridge 7, to come into contact with the lateral plate 82, that is, the rear lateral plate of the main assembly, the pressing portion 83*b* comes into contact with the pressure catching portion 40*b*, as shown in FIGS. 8(*c*) and 9(*c*), causing the cartridge 7 to be pressed (pressing position) in the direction indicated by an arrow mark J (pressing direction in FIG. 9). During this process, the cartridge positioning portion 40*a* of the cartridge 7 bumps into the cartridge catching portion 82*a* of the rear lateral plate 82 of the main assembly, correctly positioning thereby the cartridge 7 in terms of the direction perpendicular to the cartridge mounting direction. Also during this process, the cartridge movement regulating portion 86 of the main assembly becomes disengaged from the contacting surface 40*h*; a preset amount of gap is created between the cartridge movement regulating portion 86 and the surface 40*g* (recessed surface). At the same time, the cartridge catching portion 83*c* moves past the pushing portion 40*c*; a preset amount of gap is created between the cartridge catching portion 83*c* and the recessed surface 40*j*.

As described above, the cartridge pressing mechanism is structured so that the pressing member 83 can be in the standby position, pressing position, and retreat. More specifically, in terms of the top to bottom direction, the standby position, pressing position, and retreat are located in the listed order. Therefore, the pressing member 83 applies a sufficient amount of pressure to the cartridge 7.

When removing the cartridge 7 from the main assembly 100*a*, the cartridge mounting operation described above is to be carried out in reverse. The pressure which the cartridge 7 receives from the pressing member 83 is removed by the pushing portion 40*c*, which is more distant from the axial line of the hole 83*a* (rotational axis) than the pressure catching portion 40*b*, as it is during the mounting of the cartridge 7. Therefore, the amount of force necessary for the operation to remove the cartridge 7 in this embodiment is smaller than the amount of force necessary for the operation to remove a cartridge 7 in accordance with the prior art, as it is during the mounting of the cartridge 7.

Incidentally, whether mounting the cartridge 7 into the main assembly 100*a*, or removing the cartridge 7 from the main assembly 100*a*, it is necessary to move the pressing member 83 in the direction perpendicular to the cartridge mounting direction. In this embodiment, however, the projection 83*d* of the pressure catching portion 83*c* is provided with the gently slanted surfaces on the upstream and downstream sides, one for one, in terms of the cartridge mounting direction. Further, the projection 40*d* of the pushing portion 40*c* is provided with gently slanted surfaces on the upstream and downstream, one for one, in terms of the cartridge mounting direction. Further, when the cartridge 7 is mounted, the slanted surface 40*e* of the pushing portion 40*c* comes into contact with the slanted surface 83*e* of the pressure catching portion 83*c*, whereas when the cartridge 7 is removed, the slanted surface 40*f* of the pushing portion 40*c* comes into contact with the slanted surface 83*f* of the pressure catching portion 83*c*. The movement of the pressing member 83 in the direction of the arrow mark X begins under the above described condition. In other words, the cartridge pressing mechanism in this embodiment is structured so that the slanted surfaces of the cartridge 7 remain in contact with the slanted surfaces of the main assembly 100*a* while the pressing member 83 moves. Therefore, the cartridge 7 smoothly moves into the main assembly when the cartridge is mounted, and also, smoothly comes out of the main assembly when the cartridge 7 is removed.

Figure 10:
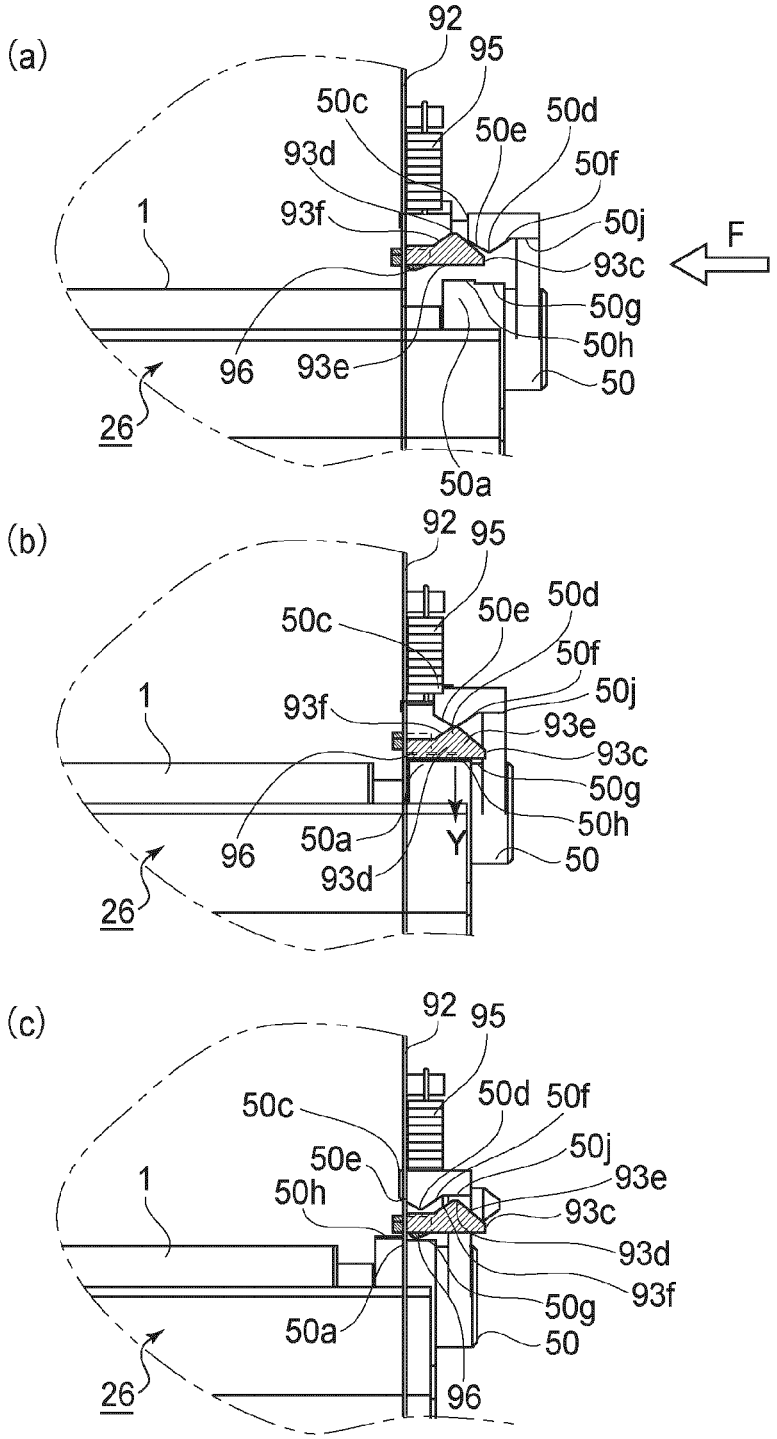
FIG. 10 is a plan view of the cartridge pressing front mechanism of the main assembly of the image forming apparatus, as seen from the left-hand side (as seen from front side of main assembly), showing the operation of the cartridge pressing mechanism.
Figure 11:
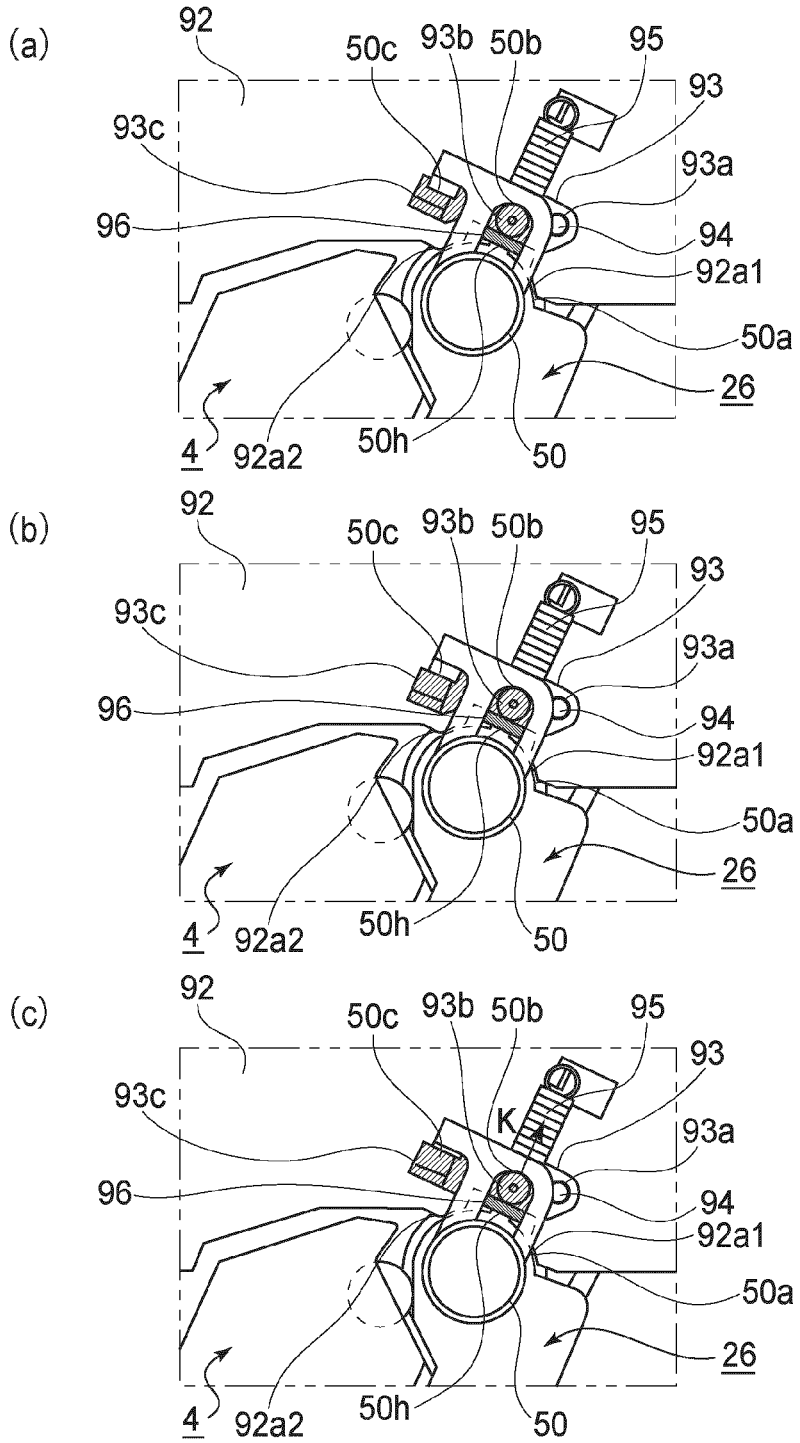
FIG. 11 is a plan view of the cartridge pressing front mechanism of the main assembly of the image forming apparatus, as seen from the trailing end side of the cartridge in terms of the direction in which the cartridge is mounted, showing the operation of the cartridge pressing mechanism.

(b) Trailing End Side: Operations of Cartridge Pressing Mechanism During Mounting and Removal of Cartridge FIG. 10 is a plan view of the left-hand side (as seen from front side) of the cartridge pressing front mechanism of the main assembly. FIG. 11 is a plan view of the front side of the cartridge pressing front (trailing end side in terms of cartridge mounting direction) mechanism of the main assembly.

As the cartridge 7 is inserted, the slanted surface 50*e* of the pushing portion 50*c* of the bearing 50, that is, the front bearing of the cartridge 7, comes into contact with the slanted surface 93*e* of the cartridge catching portion 93*c* (standby position), as shown in FIGS. 10(*a*) and 11(*a*). Then, as the cartridge 7 is inserted further, the upwardly pulling member 93 is gradually pushed down, causing the projection 50*d* of the pushing portion 50*c* to come into contact with the projection 93*d* of the cartridge catching portion 93*c*, as shown in FIG. 10(*b*). Consequently, the upwardly pulling member 93 retreats in the direction indicated by an arrow mark Y (position in retreat). More specifically, the upwardly pulling member 93 retreats into a position in which its upward force applying portion 93*b* does not contact the upward force catching portion 50*b* of the cartridge 7, as shown in FIG. 11(*b*). Therefore, while the cartridge 7 is mounted, the upward force catching portion 50*b* is not subjected to the upward pressure.

The pressure which the cartridge 7 receives from the upwardly pulling member 93 when it is mounted is removed by the pushing portion 50*c*, which is located further from the axial line of the hole 93*a* than the upward force catching portion 50*b*. That is, the amount of force necessary to push down the upwardly pulling member 93 against the force which acts to upwardly push the cartridge 7 is reduced by an amount equivalent to the ratio between the distance from the axial line of the hole 93*a* to the upward force catching portion 50*b* (upwardly pulling force applying portion 93*b*) and the distance from the axial line of the hole 93*a* to the pushing portion 50*c* (upwardly pulling member 93). Therefore, the amount of load to which the cartridge 7 is subjected when it is mounted is substantially smaller than the amount of pressure which the cartridge 7 receives from the upwardly pulling member 93; the amount of force required to mount the cartridge 7 is substantially smaller than the amount of force which the cartridge 7 receives from the upwardly pulling member 93.

Further, when the cartridge 7 is mounted, the cartridge 7 is subjected to upward force, that is, the reactive force generated as the upwardly pulling member 93 is pushed down into its retreat. However, the contacting surface 50*h* comes into contact with the cartridge movement regulating portion 96, that is, the cartridge contacting second portion of the main assembly. Therefore, the cartridge 7 is prevented from moving upward. Here, the cartridge movement regulating portion 96 of the main assembly and the main assembly contacting surface 50*h* are positioned so that they remain in contact with each other until immediately before the cartridge positioning portion 50*a* is correctly positioned by coming into contact with the cartridge catching portion 92*a*. Therefore, while the cartridge 7 is mounted, more specifically, from the moment the cartridge 7 begins to receive the upward force from the upwardly pulling member 93 until immediately before the cartridge 7 is correctly positioned, the cartridge movement regulating portion 96, that is, the cartridge regulating portion of the main assembly, which is formed of resin, and the cartridge contacting surface 50*h*, slide on each other, and therefore, the cartridge positioning portion 50*a* does not rub against the cartridge catching portion 92*a* of the main assembly, which is formed of a thin sheet of steel or the like. Therefore, the problem that the cartridge positioning portion 50*a* is shaved by the cartridge catching portion 92*a* is prevented.

As the cartridge 7 is inserted even further, the cartridge catching portion 93*c* is disengaged from the pushing portion 50*c*, and therefore, the upwardly pulling portion 93 gradually returns to the upwardly pulling position from the retreat. Then, the cartridge 7 is inserted far enough for the contacting surface 50*i*, which is for correctly positioning the cartridge 7 in terms of the lengthwise direction of the cartridge 7, to come into contact with the lateral plate 82, that is, the rear lateral plate of the main assembly, the upwardly pulling portion 93*b* comes into contact with the cartridge catching portion 50*b*, as shown in FIGS. 10(*c*) and 11(*c*), causing the cartridge 7 to be pressed (pressing position) in the direction indicated by an arrow mark K (upwardly pulling direction in FIG. 11). During this process, the cartridge positioning portion 50*a* of the cartridge 7 bumps into the cartridge catching portion 92*a* of the frontal lateral plate 92 of the main assembly, correctly positioning thereby the cartridge 7 in terms of the direction perpendicular to the cartridge mounting direction. Also during this process, the cartridge movement regulating portion 96 of the main assembly becomes disengaged from the contacting surface 50*h*; a preset amount of gap is created between the cartridge movement regulating portion 96 and the recessed surface 50*g*. At the same time, the cartridge catching portion 93*c* moves past the pushing portion 50*c*; a preset amount of gap is created between the cartridge catching portion 93*c* and the recessed surface 50*j*.

As described above, the cartridge pressing mechanism is structured so that the upwardly pulling member 93 is enabled to move into the standby position, upwardly pulling (pressing) position, and retreat. More specifically, in terms of the top to bottom direction, the standby position, upwardly pulling (pressing) position, and retreat are located in the listed order. Therefore, the upwardly pulling member 93 applies to the cartridge 7 a sufficient amount of pressure for pulling up the cartridge 7.

When removing the cartridge 7 from the main assembly 100*a*, the cartridge mounting operation described above is to be carried out in reverse. The upward force which the cartridge 7 receives from the upwardly pulling member 93 is removed by the pushing portion 50*c*, which is more distant from the axial line of the hole 93*a* (rotational axis of pulling member 93) than the upward force catching portion 50*b*, as it is during the mounting of the cartridge 7. Therefore, the amount of force necessary for the operation to remove the cartridge 7 in this embodiment is significantly smaller than the amount of force necessary for the operation to remove a cartridge 7 in accordance with the prior art, as the amount of the force necessary for the operation to mount the cartridge 7 in this embodiment is significantly smaller than the amount of force necessary for the operation to mount a cartridge in accordance with the prior art.

Incidentally, whether mounting the cartridge 7 into the main assembly 100*a*, or removing the cartridge 7 from the main assembly 100*a*, it is necessary to move the upwardly pulling member 93 in the direction perpendicular to the cartridge mounting direction. In this embodiment, however, the projection 93*d* of the pressure catching portion 93*c* is provided with the gently slanted surfaces, which are on the upstream and downstream sides, one for one, in terms of the cartridge mounting direction. Further, the projection 50*d* of the pushing portion 50*c* is provided with gently slanted surfaces, which are on the upstream and downstream, one for one, in terms of the cartridge mounting direction. Thus, when the cartridge 7 is mounted, the slanted surface 50*e* of the pushing portion 50*c* comes into contact with the slanted surface 93*e* of the pressure catching portion 93*c*, whereas when the cartridge 7 is removed, the slanted surface 50*f* of the pushing portion 50*c* comes into contact with the slanted surface 93*f* of the pressure catching portion 93*c*. It is under this condition that the movement of the upwardly pulling member 93 in the direction of the arrow mark Y begins. In other words, the cartridge pressing mechanism in this embodiment is structured so that the slanted surfaces of the cartridge 7 remain in contact with the slanted surfaces of the main assembly 100*a* while the upwardly pulling member 93 moves. Therefore, the cartridge 7 smoothly moves into the main assembly when the cartridge is mounted, and also, smoothly comes out of the main assembly when the cartridge 7 is removed.

Incidentally, when the cartridge 7 is mounted or removed, the operation of the cartridge pressing mechanism in this embodiment occurs on the leading and trailing end sides, in terms of the cartridge mounting direction, roughly at the same time. Further, the direction in which the pressing member 83, that is, the rear pressing member, is rotated is opposite from the direction in which the pressing member 93 (upwardly pulling member), that is, the front pressing member, is rotated.

Figure 12:
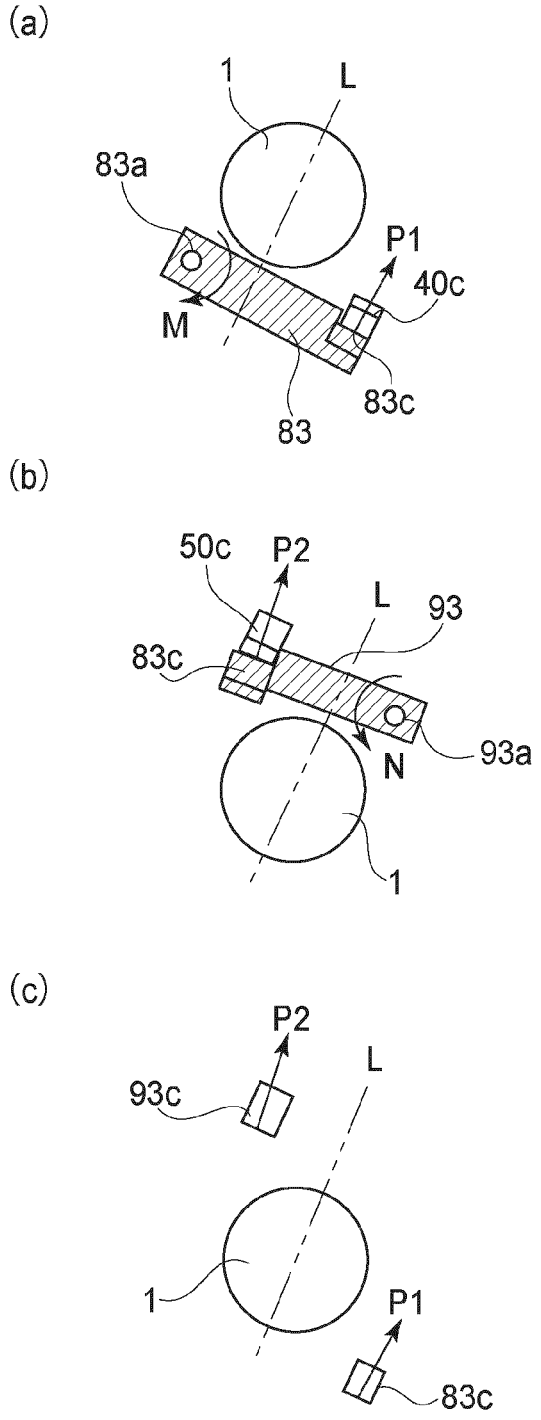
FIG. 12 is a schematic drawing which shows the directions in which force is applied during the mounting or removal of the cartridge.

To describe in more detail, referring to FIGS. 12(*a*) and 12(*b*), on the leading end side in terms of the direction perpendicular to the cartridge mounting direction, the axial line of the hole 83*a* is on the left side of Line L, which coincides with the axial line of the photosensitive drum 1 and extends in the direction parallel to the direction in which the cartridge 7 is moved to be correctly positioned, and the pressure catching portion 83*c* is on the right side of Line L. On the other hand, on the trailing end side, the axial line of the hole 93*a* is on the right-hand side of the abovementioned Line L, and the pressure catching portion 93*c* is on the left-hand side of Line L; the positional relationship between the hole and pressure catching portion of the pressing portion on the leading end side is opposite to that on the trailing end side.

That is, the pressing member 83, which is on the rear side of the main assembly, is rotated in the direction indicated by an arrow mark M when it is moved into the retreat, whereas the upwardly pulling member 93, which is on the front side of the main assembly, is rotated in the direction indicated by an arrow mark N when it is moved into the retreat. Therefore, the loads from the pressing members 83 and 93, that is, the pressing members on the rear and front sides of the main assembly, to which the pushing portions 40*c* and 50*c* are subjected when the cartridge 7 is mounted or removed, act in the directions indicated by arrow marks P1 and P2, respectively, in FIGS. 12(*a*) and 12(*c*). The angles of the directions P1 and P2 of these loads are preset relative to Line L, which extends in the direction in which the cartridge is pushed up. Further, the abovementioned angles are roughly symmetrical with reference to Line L, which extends in the direction parallel to the directions P1 and P2 of the load, that is, the direction in which the cartridge 7 is upwardly pushed, as shown in FIG. 12(*c*0. Therefore, when the cartridge 7 is mounted or removed, its remains stable in attitude, being therefore significantly better in operability than a cartridge in accordance with the prior art.

(Structural Arrangement for Preventing Shaving of Cartridge Positioning Portion of Cartridge)

The cartridge 7 in this embodiment is prevented from being shaved across its cartridge positioning portion when it is mounted into, or removed from, the main assembly 100*a*. This embodiment can reduce the problem that when the cartridge 7 is mounted into the main assembly 100*a*, the cartridge positioning first and second portions (portions 40*a* and 50*a*) of the cartridge 7 rub against the corresponding portions (members) of the main assembly 100*a*. Further, this embodiment can reduce the problem that when the cartridge 7 is mounted into the main assembly 100*a*, the abovementioned cartridge positioning first and second portions are placed in contact with the corresponding portions (members) of the main assembly 100*a*.

That is, as described above, the bearings 40 and 50, that is, the bearings on the leading and trailing end sides, in terms of the cartridge mounting direction, are provided with the contacting portions 40*h* and 50*h*, which protrude upward beyond the cartridge positioning portions 40*a* and 50*a*, which also are the portions of their peripheral surfaces. These contacting portions 40*h* and 50*h* are flat across the top surface, and positioned on one side of the cartridge positioning portion of the cartridge 7, and the other, respectively.

As the cartridge 7 is inserted into the main assembly 100*a* structured as described above, the cartridge 7 is subjected to the upward force, that is, the reactive force generated as the pressing member 83, that is, the cartridge pressing rear member, and the upwardly pulling member 93, that is, the cartridge pressing front member, are pushed downward into their retreats. During this process, the contacting portion 40*h* (surface) comes into contact with the cartridge movement regulating portion 86, that is, the cartridge contacting first portion of the main assembly, and the contacting portion 50*h* (surface) comes into contact with the cartridge movement regulating portion 96, that is, the cartridge contacting second portion of the main assembly. Therefore, the cartridge 7 is prevented from moving upward.

Here, the cartridge pressing mechanism is structured so that the cartridge movement regulating portion 86, that is, the cartridge movement regulating portion of the main assembly, which is on the rear side of the main assembly, and the contacting portion 40*h* (surface) remain in contact with each other until immediately before the cartridge positioning portion 40*a* is correctly positioned by coming into contact with the cartridge catching portion 82*a*. Similarly, the cartridge movement regulating portion 96, that is, the cartridge movement regulating portion of the main assembly, which is on the front side of the main assembly, and the contacting portion 50*h* (surface) remain in contact with each other until immediately before the cartridge positioning portion 50*a* is correctly positioned by coming into contact with the cartridge catching portion 92*a*.

Therefore, while the cartridge 7 is mounted, more specifically, from the moment the cartridge 7 begins to receive the upward force from the pressing member 83 and upwardly pulling member 93 until immediately before the cartridge 7 is correctly positioned, the cartridge movement regulating portions 86 and 96, that is, the cartridge regulating portions of the main assembly, which is formed of resin, and the cartridge contacting surfaces 40*h* and 50*h*, slide on the cartridge movement regulating portions 86 and 96, respectively, and therefore, the cartridge positioning portions 40*a* and 50*a*, which are on the rear and front sides, do not rub against the cartridge catching portions 82*a* and 92*a* of the main assembly, which are formed of a thin sheet of steel or the like. Therefore, the problem that the cartridge positioning portions 40*a* and 50*a* are shaved by the cartridge catching portions 82*a* and 92*a* is prevented.

As described above, the cartridge pressing mechanism is structured so that the cartridge 7 is mounted or removed while cancelling the cartridge pressing force by the pressure applied to the point of the pressing member, which is farther from the portion of the pressing member, by which the pressing member presses on the cartridge 7. Therefore, the amount of force necessary to mount or remove the cartridge 7 is sufficiently small relative to the amount of force (pressure) which the cartridge 7 receives from the pressing member. Thus, the amount of force required to mount the cartridge 7, that is, the cartridge in this embodiment, into the main assembly of the image forming apparatus in this embodiment, or remove the cartridge 7 from the image forming apparatus in this embodiment, is significantly smaller than that required to mount a cartridge in accordance with the prior art into the main assembly of an image forming apparatus in accordance with the prior art, or removing the cartridge in accordance with the prior art from the main assembly of the image forming apparatus in accordance with the prior art. In other words, the present invention can provide a cartridge and an image forming apparatus, which are significantly better in operability in terms of the mounting of the cartridge.

Further, when mounting the cartridge 7 into the main assembly 100*a*, or removing the cartridge 7 from the main assembly 100*a*, the cartridge positioning members are prevented from being shaved. Therefore, it is ensured that the cartridge 7 is correctly positioned.

Incidentally, the structure of the image forming apparatus in this embodiment is such that the cartridges are juxtaposed side by side (in parallel) in a horizontal straight row, and also, that the intermediary transfer unit is disposed on the top side of the cartridges so that the cartridges can be pressed upward from below by the pressing members. However, this embodiment is not intended to limit the present invention in terms of image forming apparatus structure. For example, the present invention is also applicable to an image forming apparatus structured so that its intermediary transfer unit is on the under side of the cartridges, and the cartridges are pressed downward from above by the pressing member (pressuring member). In the case of such a structural arrangement, the photosensitive drum 1 is placed in contact with the intermediary transfer belt 5 by applying downward pressure to the cartridge 7.

In the case of an image forming apparatus, such as the one in this embodiment, which is structured so that the cartridges are pressed from below, the amount of force necessary to press a cartridge to correctly position the cartridge needs to be set in consideration of the weight of the cartridge itself. Therefore, it must be greater than the amount of force necessary to press a cartridge in an image forming apparatus structured so that the cartridge is pressed from above, and so is the amount of force necessary to push down the pressing member. Thus, the effects of the present invention can be further enhanced by structuring the image forming apparatus so that the cartridge can be mounted or removed while cancelling the pressure applied to the cartridge by the cartridge pressing portion of the cartridge pressing member, by the portion of the cartridge pressing member, which is farther from the rotational axis of the cartridge pressing member than the cartridge pressing portion of the cartridge pressing member.

Also in this embodiment, it is on both the leading and trailing end sides of the cartridge, in terms of the cartridge mounting direction, that the force from the cartridge pressing member (inclusive of upwardly pulling member) is cancelled by the portion of the cartridge pressing member, which is farther from the axial line the pressing member than the cartridge pressing portion of the pressing member while the cartridge is mounted or removed. However, this embodiment is not intended to limit the present invention in scope in terms of the structure of an image forming apparatus. For example, an image forming apparatus may be structured so that only one end of the image forming apparatus, that is, either the leading or trailing end in terms of the cartridge mounting direction, is provided with the cartridge pressing member. However, an image forming apparatus having the pressing member on both the leading and trailing end in terms of the cartridge mounting direction is smaller in the total amount of force necessary to mount or remove the cartridge than an image forming apparatus having the cartridge pressing member on only the leading or trailing end in terms of the cartridge mounting direction. Also as described above, by structuring an image forming apparatus so that the cartridge pressing member on the rear side, and the cartridge pressing member (cartridge pulling member) on the front side, are symmetrical with respect to the direction in which the load from the pressing member is pushed up, it is possible to keep the cartridge 7 stable in attitude when mounting or removing the cartridge 7, enhancing further the effects of this embodiment of the present invention.

Embodiment 2

Next, referring to FIGS. 13 and 14, the second embodiment of the present invention will be described. By the way, this embodiment is the same in the basic structure of an image forming apparatus as the first embodiment described above. Therefore, this embodiment will be described regarding only the structural features different from those in the first embodiment to avoid the repetition of the same description. Further, the members, portions, etc., of the image forming apparatus in this embodiment, which are the same in function as those in the first embodiment described above, are given the same referential symbols.

Figure 13:
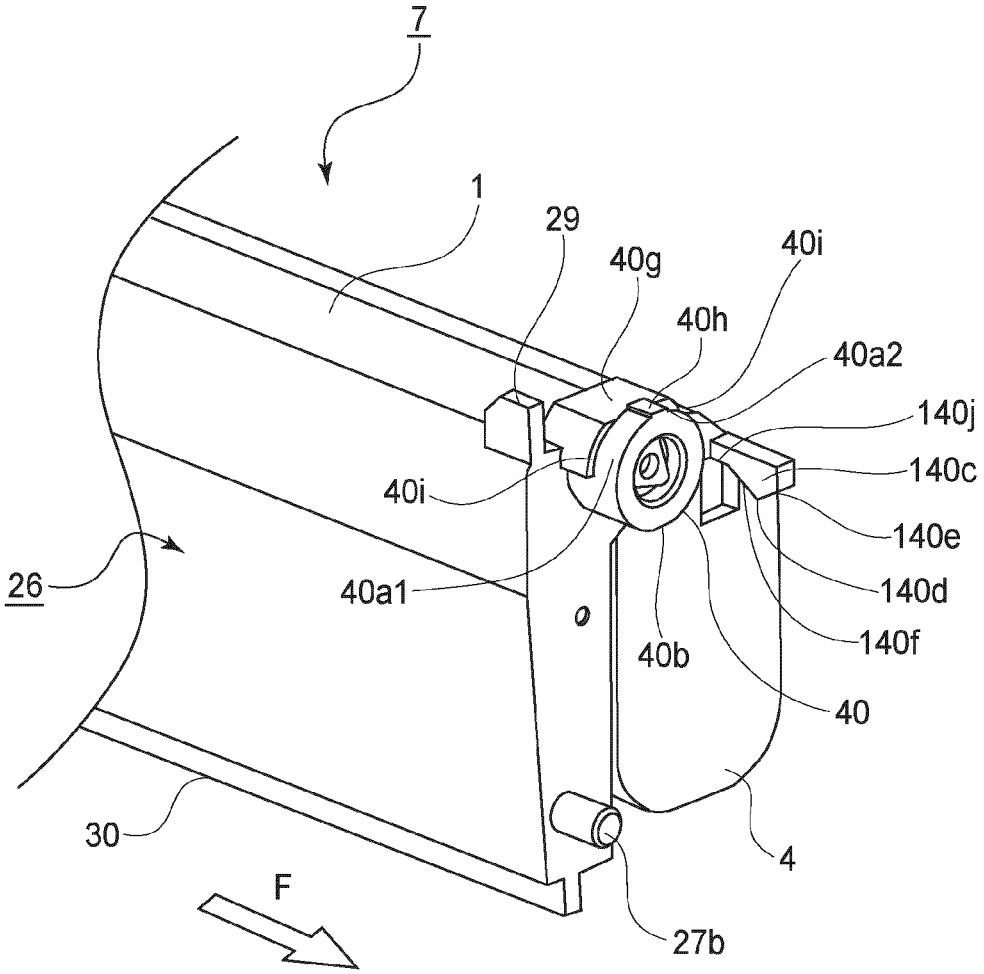
FIG. 13 is an external perspective view of the cartridge in the second embodiment of the present invention.

FIG. 13 is an external perspective view of the cartridge in this embodiment. FIG. 14 is a schematic perspective view of the cartridge positioning member and cartridge pressing member on the rear side of the main assembly of the image forming apparatus, showing their structures.

The image forming apparatus in the first embodiment was structured so that the bearing of the cartridge 7, which is on the leading end, in terms of the direction in which the cartridge 7 is mounted into the main assembly of the image forming apparatus, is provided with the pressing member 83 having the pushing portion 83*c* for pushing down the cartridge 7. In this embodiment, the image forming apparatus structured so that the pushing portion for pushing down the pressing member is a part of the development unit, will be described.

Referring to FIG. 12, it is the development unit 4 that is provided with a pressing member pushing portion 140*c*, which is for moving the pressing member into its retreat. The pushing portion 140*c* protrudes downstream from the downstream end of the cartridge 7 in terms of the cartridge mounting direction. The end portion of the pushing portion 140*c* is provided with a projection 140*d*, which projects downward. The projection 140*d* is provided with two surfaces 140*e* and 140*f*, which are gently slanted so that the intersection of the two surfaces is the peak of the projection 140*d*. In terms of the direction perpendicular to the cartridge mounting direction, the pushing portion 140*c* is on the opposite side of the pressure catching portion 40*b* from the axial line of the hole 183*a* (FIG. 14) of the cartridge pressing member 183 (pressure applying member), which will be described later. Further, the pushing portion 140*c* is located farther from the axial line of the hole 183*a* than the pressure catching portion 40*b*.

Figure 14:
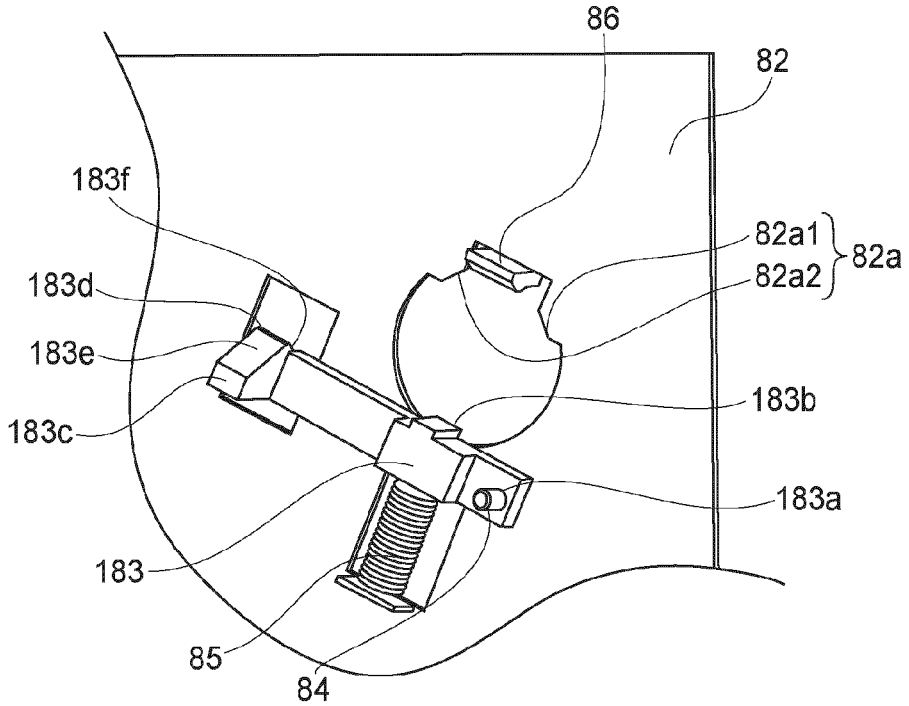
FIG. 14 is a schematic drawing which depicts the cartridge positioning mechanism and cartridge pressing mechanism of the main assembly of the image forming apparatus in the second embodiment of the present invention.

Referring to FIG. 14, as for the main assembly 100*a*, it is provided with the cartridge pressing member 183, which is for pressing the cartridge 7 toward the cartridge catching portion 82*a* (pressure catching portion). The pressing member 183 is located below the cartridge catching portion 82*a*. The pressing member 183 is attached to the lateral plate 82, that is, the lateral plate of the main assembly on the rear side; the shaft 84 solid attached to the lateral plate 82 is put through the hole 183*a* of the pressing member 183 so that the pivotal axis of the pressing member 183 coincides with the axial line of the hole 183*a*. Further, the pressing member 183 is rotatably attached to the lateral plate 82 so that it is rotatably movable to the cartridge pressing position, in which it presses the cartridge 7 upon the cartridge catching portion 82*a*, and the retreat into which it is moved to remove the pressure which it applies to the cartridge 7.

Further, the pressing member 183 is provided with a pressing portion 183*b*, which presses on the cartridge 7 when the pressing member 183 is in the pressing position. The pressing portion 183*b* corresponds in position to the pressure catching portion 40*b* of the cartridge 7. The pressing member 183 is also provided with a pressure catching portion 183*c*, which is for moving the pressing member 183 into the retreat. The pressure catching portion 183*c* corresponds in position to the pushing portion 140*c* of the cartridge 7.

The pressure catching portion 183*c* is provided with an upward projection 183*d*, which has two surfaces 183*e* and 183*f*. The surfaces 183*e* and 183*f* are on the downstream and upstream sides, respectively, in terms of the cartridge mounting direction, and are gently slanted so that their intersection is the peak of the projection 183*d*.

In terms of the direction perpendicular to the cartridge mounting direction, the pressure catching portion 183*c* is on the opposite side of the pressing portion 183*b* from the axial line of the hole 183*a*. Further, the pressure catching portion 183*c* is located farther from the axial line of the hole 183*a* than the pressing portion 183*b*.

Figure 16:
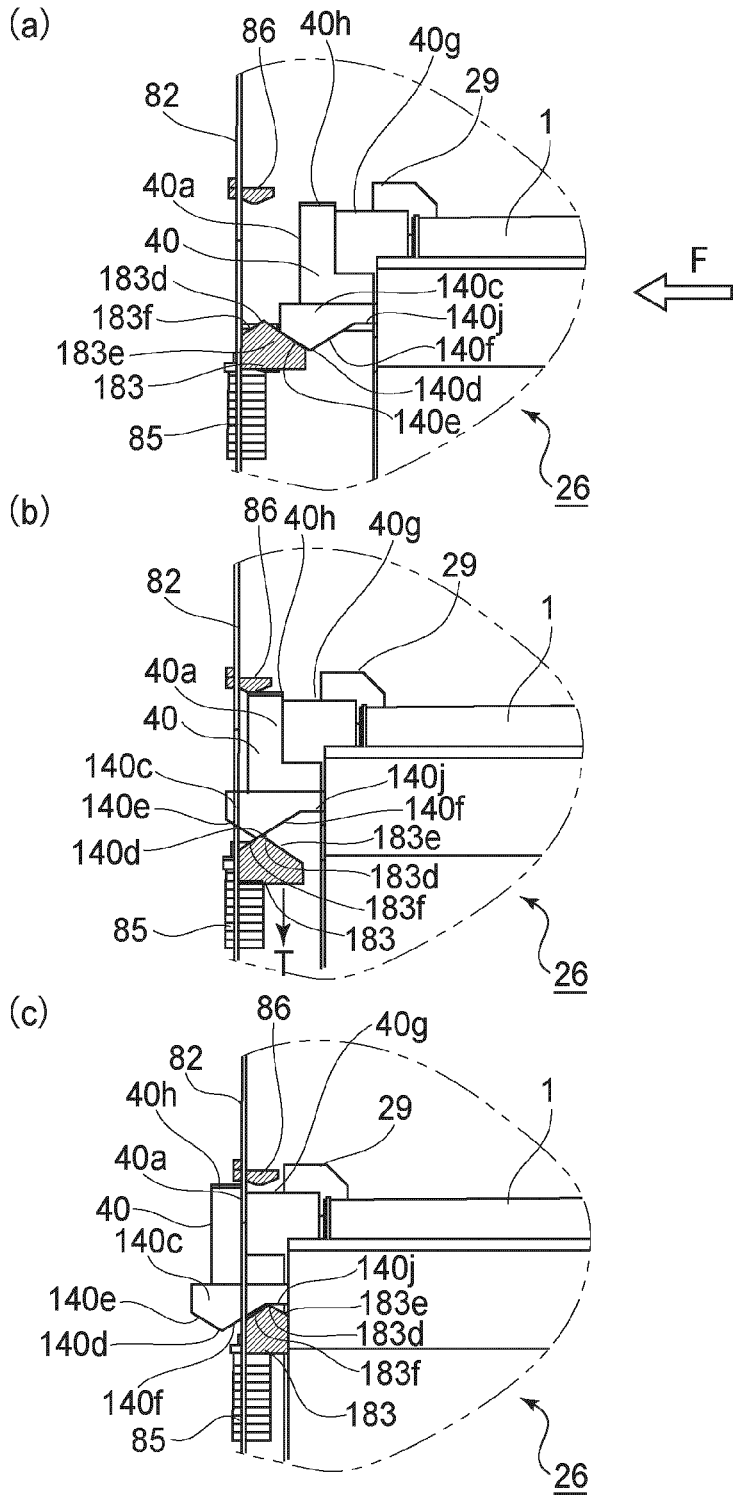
FIG. 16 is a plan view of the cartridge pressing rear mechanism of the main assembly of the image forming apparatus in the second embodiment, as seen from the right-hand side (as seen from front side of main assembly), showing the operation of the cartridge pressing mechanism.
Figure 17:
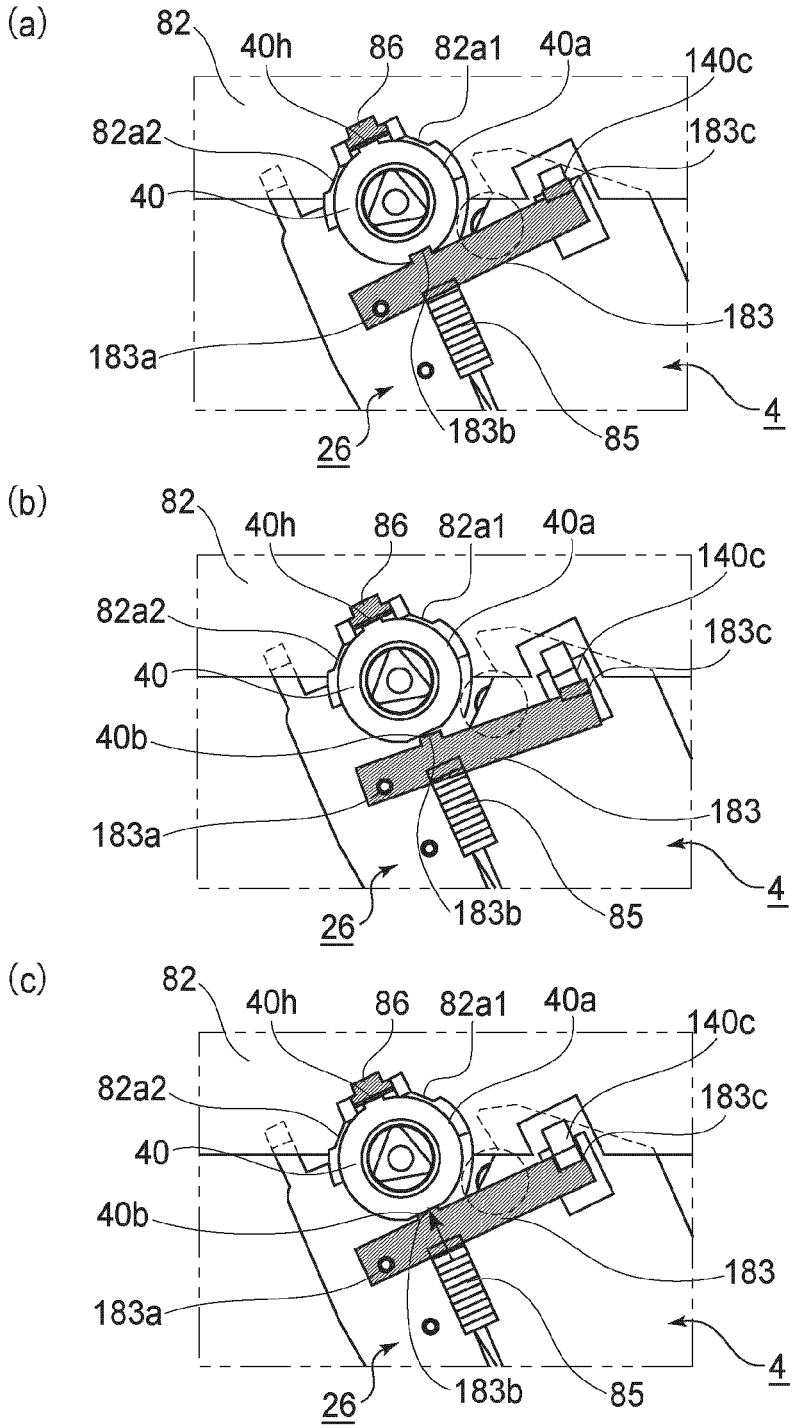
FIG. 17 is a plan view of the cartridge pressing rear mechanism of the main assembly of the image forming apparatus in the second embodiment, as seen from the leading end side of the cartridge in terms of the direction in which the cartridge is mounted, showing the operation of the cartridge pressing mechanism.

Next, the movement of the components of the cartridge pressing mechanism in this embodiment, which occur when the cartridge 7 is mounted into the image forming apparatus 100, will be described. FIG. 16 is a plan view of the cartridge pressing rear mechanism, as seen from the left side (as seen from front side of image forming apparatus) of the main assembly of the image forming apparatus, and shows the operation of the cartridge pressing member, which occurs when the cartridge 7 is mounted into the main assembly 100. FIG. 17 is a plan view of the cartridge pressing rear mechanism, as seen from the leading end side of the cartridge 7 in terms of the cartridge mounting direction, and shows the operation of the pressing member.

The cartridge 7 is mounted in the direction indicated by an arrow mark F shown in FIG. 16(*a*). Referring to FIGS. 16(*a*) and 17(*a*), as the cartridge 7 is inserted, the slanted surface 140*e* of the pushing portion 140*c* of the development unit 4 comes into contact with the slanted surface 183*e* of the cartridge catching portion 183*c* (standby position). Then, as the cartridge 7 is inserted further, the pressing member 183 is gradually pushed down, causing the projection 140*d* of the pushing portion 140*c* to come into contact with the projection 183*d* of the cartridge catching portion 183*c*, as shown in FIG. 16(*b*). Consequently, the pressing member 183 retreats in the direction indicated by an arrow mark T (position in retreat). More specifically, the pressing member 183 retreats into the position (position in retreat) in which its pressing portion 183*b* does not contact the pressure catching portion 140*b* of the cartridge 7, as shown in FIG. 17(*b*). Therefore, while the cartridge 7 is mounted, the pressure catching portion 140*b* is not subjected to any pressure. The pressure which the cartridge 7 receives from the pressing member 183 when it is mounted is cancelled by the pushing portion 140*c*, which is located further from the rotational axis of the pressing member 183, which coincides with the axial line of the hole 183*a*. That is, the amount of force necessary to push down the pressing member 183 against the force which acts to upwardly pushing the cartridge 7 is reduced by the ratio between the distance from the axial line of the hole 183*a* to the pressure catching portion 140*b* (pushing portion 183*b*) and the distance from the axial line of the hole 183*a* to the pushing portion 140*c* (pressure catching portion 183*c*). Therefore, the amount of load to which the cartridge 7 is subjected when it is mounted is substantially smaller than the amount of pressure which the cartridge 7 receives from the pressing member 183; the amount of force required to mount the cartridge 7 is substantially smaller than the amount of the pressure required to mount a cartridge (7) in accordance with the prior art.

Further, when the cartridge 7 is mounted, the cartridge 7 is subjected to upward force, that is, the reactive force generated as the pressing member 183 is pushed down into its retreat. However, the contacting surface 40*h* comes into contact with the cartridge movement regulating portion 86, that is, the cartridge contacting first portion of the main assembly. Therefore, the cartridge 7 is prevented from being moved upward. Here, the cartridge movement regulating portion 86 of the main assembly and the main assembly contacting second surface 40*h* of the cartridge 7 are positioned so that they remain in contact with each other until immediately before the cartridge positioning portion 40 (a pressure catching portion) is correctly positioned by coming into contact with the cartridge catching portion 82*a*. Therefore, while the cartridge 7 is mounted, more specifically, from the moment the cartridge 7 begins to receive the upward pressure from the pressing member 183 until immediately before the cartridge 7 is correctly positioned, the cartridge movement regulating portion 86, that is, the cartridge movement regulating portion of the main assembly, which is formed of resin, and the contacting surface 40*h*, slide on each other, and the pressure catching portion 40*a* (cartridge positioning portion of cartridge) does not rub against the cartridge catching portion 82*a* of the main assembly, which is formed of a thin sheet of steel or the like. Therefore, the problem that the cartridge positioning portion 40*a* is shaved by the cartridge catching portion 82*a* is prevented.

As the cartridge is inserted even further, the cartridge catching portion 183*c* is disengaged from the pushing portion 140*c*, and therefore, the pressing member 183 gradually returns to the pressing position from the retreat. Then, the cartridge 7 is inserted far enough for the contacting surface 40*i*, which is for correctly positioning the cartridge 7 in terms of the lengthwise direction of the cartridge 7, to come into contact with the lateral plate 82, that is, the rear lateral plate of the main assembly, the pressing portion 183*b* comes into contact with the pressure catching portion 40*b*, as shown in FIGS. 16(*c*) and 17(*c*), causing the cartridge 7 to be pressed (pressing position) in the direction indicated by an arrow mark S (pressing direction). During this process, the cartridge positioning portion 40*a* of the cartridge 7 bumps into the cartridge catching portion 82*a* of the rear lateral plate 82 of the main assembly, correctly positioning thereby the cartridge 7 in terms of the direction perpendicular to the cartridge mounting direction. Also during this process, the cartridge movement regulating portion 86 of the main assembly becomes disengaged from the second contacting surface 40*h*; a preset amount of gap is provided between the cartridge movement regulating portion 86 and the surface 40*g* (recessed surface). At the same time, the cartridge catching portion 183*c* moves past the pushing portion 140*c*; a preset amount of gap is provided between the cartridge catching portion 183*c* and the recessed surface 140*j*.

Also in this embodiment, the pressing member 183 is enabled to apply a sufficient amount of pressure to the cartridge 7.

When removing the cartridge 7 from the main assembly 100*a*, the cartridge mounting operation described above is to be carried out in reverse. The upward force which the cartridge 7 receives from the pressing member 183 is cancelled by the pushing portion 140*c*, which is located farther from the axial line of the hole 183*a*, as it is during the mounting of the cartridge 7. Therefore, the amount of force necessary for the operation to remove the cartridge 7 in this embodiment is significantly smaller than the amount of force necessary for the operation to remove a cartridge 7 in accordance with the prior art, as the amount of the force necessary for the operation to mount the cartridge 7 in this embodiment is significantly smaller than the amount of force necessary for the operation to mount a cartridge in accordance with the prior art.

Further, as the cartridge catching portion 82*a* of the main assembly becomes disengaged from the pressure catching portion 40*a* (cartridge positioning portion of cartridge), the cartridge movement regulating portion 86 of the main assembly comes into contact with the second contacting surface 40*h*. Further, even during the removal of the cartridge 7, the cartridge movement regulating portion 86 of the main assembly, which is formed of resin, and the second contacting surface 40*h*, slide against each other, preventing thereby the pressure catching portion 40*a* from rubbing against the cartridge catching portion 82*a* of the lateral plate of the main assembly, as long as the cartridge 7 is under the upward force applied by the pressing member 183. Therefore, the problem that the pressure catching portion 40*a* (cartridge positioning portion of cartridge) is shaved by the cartridge catching portion 82*a* as it rubs against the cartridge catching portion 82*a* is prevented.

In this embodiment, only the portion of the development unit 4, which corresponds in position to the rear end side of the main assembly of the image forming apparatus, is provided with the pushing portion. However, it may be only the front end of the development unit that is provided with the pushing portion. The effects of providing only the front end of the development unit with the pushing portion are the same as that achievable by providing only the rear end of the development unit with the pushing portion.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Applications Nos. 331309/2006 filed Dec. 8, 2006, and 266399/2007 filed Oct. 12, 2007, which are hereby incorporated by reference.

What is claimed is:

1. An image forming apparatus for forming an image on a recording material, said image forming apparatus comprising:

a main assembly including:

(a) a main assembly side plate, (b) a main assembly side positioning portion, (c) a main assembly side regulating portion that is provided on said main assembly side plate, and (d) a main assembly slanted surface; and a detachably mountable process cartridge positioned at said main assembly side positioning portion, said process cartridge including:

(i) a cartridge side portion-to-be-positioned configured to be positioned at said main assembly side positioning portion when said process cartridge is mounted to said main assembly, and (ii) a cartridge side portion-to-be-regulated configured to be regulated to prevent contact of said cartridge side portion-to-be-positioned to said main assembly side positioning portion by contact between said main assembly side regulating portion and said cartridge side portion-to-be-regulated, wherein, when said process cartridge is inserted into said main assembly along a longitudinal direction of said process cartridge, said process cartridge contacts said main assembly slanted surface so that said cartridge side portion-to-be-regulated comes into contact with said main assembly side regulating portion and said cartridge side portion-to-be-positioned is positioned at said main assembly side positioning portion.

2. An apparatus according to claim 1, wherein said process cartridge includes a photosensitive drum, and the longitudinal direction is an axial direction of said photosensitive drum.

3. An apparatus according to claim 2, further comprising an intermediate transfer belt onto which images are transferred from said photosensitive drum.

4. An apparatus according to claim 3, wherein, when said process cartridge is positioned to said main assembly side positioning portion, said photosensitive drum contacts said intermediary transfer belt.

5. An apparatus according to claim 1, wherein said image forming apparatus comprises a plurality of process cartridges including said process cartridge, and said plurality cartridges are positioned to main assembly side positioning portions in substantially equally inclined states relative to a horizontal direction.

* * * * *